US009343252B2

(12) United States Patent
Ashtekar et al.

(10) Patent No.: US 9,343,252 B2
(45) Date of Patent: May 17, 2016

(54) ARC EXTINGUISHING CONTACT ASSEMBLY FOR A CIRCUIT BREAKER ASSEMBLY

(71) Applicant: Eaton Corporation, Cleveland, OH (US)

(72) Inventors: Koustubh Dnyandeo Ashtekar, Moon Township, PA (US); James Jeffery Benke, Pittsburgh, PA (US)

(73) Assignee: EATON CORPORATION, Cleveland, OH (US)

( * ) Notice: Subject to any disclaimer, the term of this patent is extended or adjusted under 35 U.S.C. 154(b) by 24 days.

(21) Appl. No.: 14/469,621

(22) Filed: Aug. 27, 2014

(65) Prior Publication Data

US 2016/0064169 A1 Mar. 3, 2016

Related U.S. Application Data

(62) Division of application No. 14/469,614, filed on Aug. 27, 2014.

(51) Int. Cl.

| | |
|---|---|
| ***H01H 33/64*** | (2006.01) |
| ***H01H 33/12*** | (2006.01) |
| ***H01H 1/02*** | (2006.01) |
| ***H01H 1/06*** | (2006.01) |

(52) U.S. Cl.

CPC ..... *H01H 33/12* (2013.01); *H01H 1/02* (2013.01); *H01H 1/06* (2013.01); *H01H 33/64* (2013.01)

(58) Field of Classification Search

CPC H01H 71/02; H01H 71/0271; H01H 71/1045

See application file for complete search history.

(56) References Cited

U.S. PATENT DOCUMENTS

| | | | | | |
|---|---|---|---|---|---|
| 4,500,762 | A * | 2/1985 | Yoshizumi | H01H 33/24 | 218/12 |
| 5,262,605 | A * | 11/1993 | Pham | H01H 33/161 | 218/143 |
| 5,373,131 | A * | 12/1994 | Perret | H01H 33/98 | 218/63 |
| 5,567,924 | A * | 10/1996 | Yano | H01H 33/166 | 218/143 |

(Continued)

FOREIGN PATENT DOCUMENTS

| | | |
|---|---|---|
| EP | 2455957 | 5/2012 |
| GB | 1 590 725 A | 6/1981 |
| WO | WO2013153112 | 10/2013 |

OTHER PUBLICATIONS

European Patent Office, "International Search Report and Written Opinion for corresponding PCT/US2015/031531", Sep. 10, 2015, 11 pp.

*Primary Examiner* — Truc Nguyen

(74) *Attorney, Agent, or Firm* — Eckert Seamans Cherin & Mellott, LLC; David C. Jenkins; Grant E. Coffield

(57) ABSTRACT

An arc extinguishing contact assembly for a circuit breaker assembly is provided. The arc extinguishing contact assembly includes a fixed contact assembly, a movable contact assembly and an arc extinguishing assembly. The fixed contact assembly includes a fixed arc contact assembly, a fixed main contact assembly, and a number of movable, intermediate arc contact assemblies. The movable contact assembly includes a movable arc contact assembly and a movable main contact assembly. The arc extinguishing assembly is structured to extinguish an arc generated as the movable contact assembly moves between an open, first position and a closed, second position.

16 Claims, 16 Drawing Sheets

(56) References Cited

U.S. PATENT DOCUMENTS 5,585,610 A * 12/1996 Meyer ..... H01H 33/7061 218/57
7,078,643 B2 * 7/2006 Rostron ..... H01H 33/166 218/144
8,148,660 B2 4/2012 Seeger et al.
8,502,101 B2 8/2013 Niemeyer et al.
8,957,342 B2 * 2/2015 McCord ..... H01H 33/168 218/143
2001/0002664 A1 6/2001 Stechbarth et al.
2003/0094437 A1 * 5/2003 Hirose ..... H01H 33/7076 218/57
2008/0135817 A1 6/2008 Luly et al.
2009/0078680 A1 3/2009 Franck et al.
2009/0294406 A1 12/2009 Bessede et al.
2013/0270228 A1 * 10/2013 Nakada ..... H01H 33/12 218/158

* cited by examiner

TOP SPRING EXTENDED

CLOSE

TOP AND MIDDLE ARCHING CONTACTS ALSO SEPARATE

INTERMEDIATE STAGE

OPEN

ARC EXTINGUISHING CONTACT ASSEMBLY FOR A CIRCUIT BREAKER ASSEMBLY

CROSS REFERENCE TO RELATED APPLICATION

This application is a divisional application of and claims priority to U.S. patent application Ser. No. 14/469,614, filed Aug. 27, 2014, entitled Arc Extinguishing Contact Assembly for a Circuit Breaker Assembly.

BACKGROUND OF THE INVENTION

1. Field of the Invention

The disclosed concept relates to an arc extinguishing contact assembly for a circuit breaker assembly and, more particularly to an arc extinguishing contact assembly for a circuit breaker assembly that utilizes a number of displaced pressure zones adjacent a conductive element of the contact assembly to extinguish an arc.

2. Background Information

Air, or gas, circuit breakers include a contact assembly disposed in a chamber. The contact assembly includes both main contacts and arc contacts. That is, there are a number of main fixed contacts and a number of main movable contacts wherein each movable contact has an associated fixed contact. The associated contacts are also identified herein as a "pair of main contacts" or a "set of main contacts." Each movable main contact moves between an open, first position, wherein the movable main contact is spaced from and not in electrical communication with the associated fixed main contact, and, a closed, second position, wherein the movable main contact is directly coupled to and in electrical communication with the associated main fixed contact.

Similarly, each set of arc contacts includes a fixed arc contact and a movable arc contact. As with the main contacts, the arc contacts are disposed in pairs with the movable arc contact moveable between an open, first position, wherein the movable arc contact is spaced from and not in electrical communication with the associated fixed arc contact, and, a closed, second position, wherein the movable arc contact is directly coupled to and in electrical communication with the associated arc fixed contact. The arc contacts are structured to be directly coupled to each other before the main contacts when the movable contact assembly is moving into the closed position, and, are structured to decouple after the associated main contacts when the movable contact assembly is moving into the open position. When the movable arc contact is a specific distance from the fixed arc contact, when moving either toward or away therefrom, an arc forms between the movable arc contact and the fixed arc contact. The arc causes a number of problems including, but not limited to, degradation of the contacts. That is, the arc scorches the contacts. Further, the arc generates hot and hazardous gases with extreme pressure. The eroded/degraded contacts have an oxide layer on the contacts that increases the contact resistance between the main contacts which further increases the contact temperature due to ohmic heating and thus, limits the current carrying capability of the circuit breaker. Further, degradation makes circuit breaker inoperative and useless.

It is known to use directed fluid (gas) flow to extinguish, or assist in extinguishing, an arc. That is, the fluid passes through a fluid control port adjacent to the arc contacts and assists in dissipating the arc. In this configuration, the fluid control port may be one of the elements that is scorched by the arc. The fluid control port, which may be specifically shaped, and therefore is more expensive than other components, degrades over time and needs replaced. In this configuration, the arc suppression system is known as a "puffer," and the circuit breaker is known as a "puffer breaker." In a puffer breaker, generally, the arcing contacts are changed regularly and commonly identified as "consumables." Replacement of the consumables usually happens in the high voltage circuit breakers where the arcing damage to the arcing contacts occurs frequently. Medium and low voltage circuit breakers also suffer degradation, but typically at a slower rate.

The fluid control ports, i.e. the fluid passages that direct the suppression fluid, are generally formed in one of two ways: 1) machined ports in the arc extinguishing components, or, 2) formed in-between the relative positions of the moving components. It is possible that both types of fluid passages are damaged due to arc scorching.

Further, the contact assemblies generally include large, conductive contact elements. These elements, typically made from copper, are expensive and difficult to replace. The inadequate design of copper alloy contacts put extra responsibility on the arc quenching media for the arc interruption. A puffer breaker, typically, uses Sulfur Hexafluoride (SF6) gas as an arc quenching media. SF6 gas has higher global-warming potential value, may be harmful to humans, and otherwise degrades the environment. If the air is used as a quenching media in a puffer breaker, the size of the circuit breaker is larger than that of a SF6 puffer breaker because of relatively lower arc quenching capability of air.

There is, therefore, a need for an arc extinguishing contact assembly for a circuit breaker assembly that overcomes these disadvantages. There is, for example, a need for an arc extinguishing contact assembly for a circuit breaker assembly wherein the local voltage of the arc is reduced by dividing the arc in multiple arcs and thereby limiting the deleterious effects of the arc. There is a further need for an arc extinguishing contact assembly for a circuit breaker assembly that reduced the contact erosion. There is a further need for an arc extinguishing contact assembly for a circuit breaker assembly, such as but not limited to a fluid control port, including a swirling gas passage, is spaced from the contact assembly. There is a further need for an arc extinguishing contact assembly for a circuit breaker assembly including different emission materials positioned in the arcing contacts whereby the arc is controlled.

SUMMARY OF THE INVENTION

These needs, and others, are met by at least one embodiment of the disclosed and claimed concept which provides for an arc extinguishing contact assembly that includes a fixed contact assembly, a movable contact assembly and an arc extinguishing assembly. The fixed contact assembly includes a fixed arc contact assembly, a fixed main contact assembly, and a number of movable, intermediate arc contact assemblies. The movable contact assembly includes a movable arc contact assembly and a movable main contact assembly. The arc extinguishing assembly is structured to extinguish an arc generated as the movable contact assembly moves between an open, first position and a closed, second position. The number of intermediate arc contact assemblies reduces the individual arc resistance and thereby reduces the degradation caused by the arcs. The arc extinguishing contact assembly extinguishes the high power arc, similar to an arc chute, but utilizes high pressure gases to accomplish this result.

Further, the arc extinguishing assembly also, or alternatively, includes arc extinguishing elements such as a fixed contact assembly with a number of intermediate arc contact assemblies whereby the theoretical arc (defined below) is divided into multiple local arcs wherein the local arcs have a reduced voltage relative to said theoretical arc. The arc extinguishing elements may further include an intermediate first arc contact assembly conductive insert body including an arc attracting metal and an arc repelling material disposed in an arc controlling configuration. The arc extinguishing elements may further include an arc suppressing fluid disposed within the circuit breaker housing assembly.

BRIEF DESCRIPTION OF THE DRAWINGS

A full understanding of the invention can be gained from the following description of the preferred embodiments when read in conjunction with the accompanying drawings in which:

FIG. 1A is a cross-sectional side view of a circuit breaker with the movable contact assembly in an open, first position. FIG. 1B is a cross-sectional side view of a circuit breaker with the movable contact assembly in an open, first position, but with different reference numbers. FIG. 1C is a cross-sectional side view of a circuit breaker with a number of contacts in an arcing position. FIG. 1D is a cross-sectional side view of a circuit breaker with the movable contact in a closed, second position.

DESCRIPTION OF THE PREFERRED EMBODIMENTS

Figure 1A:
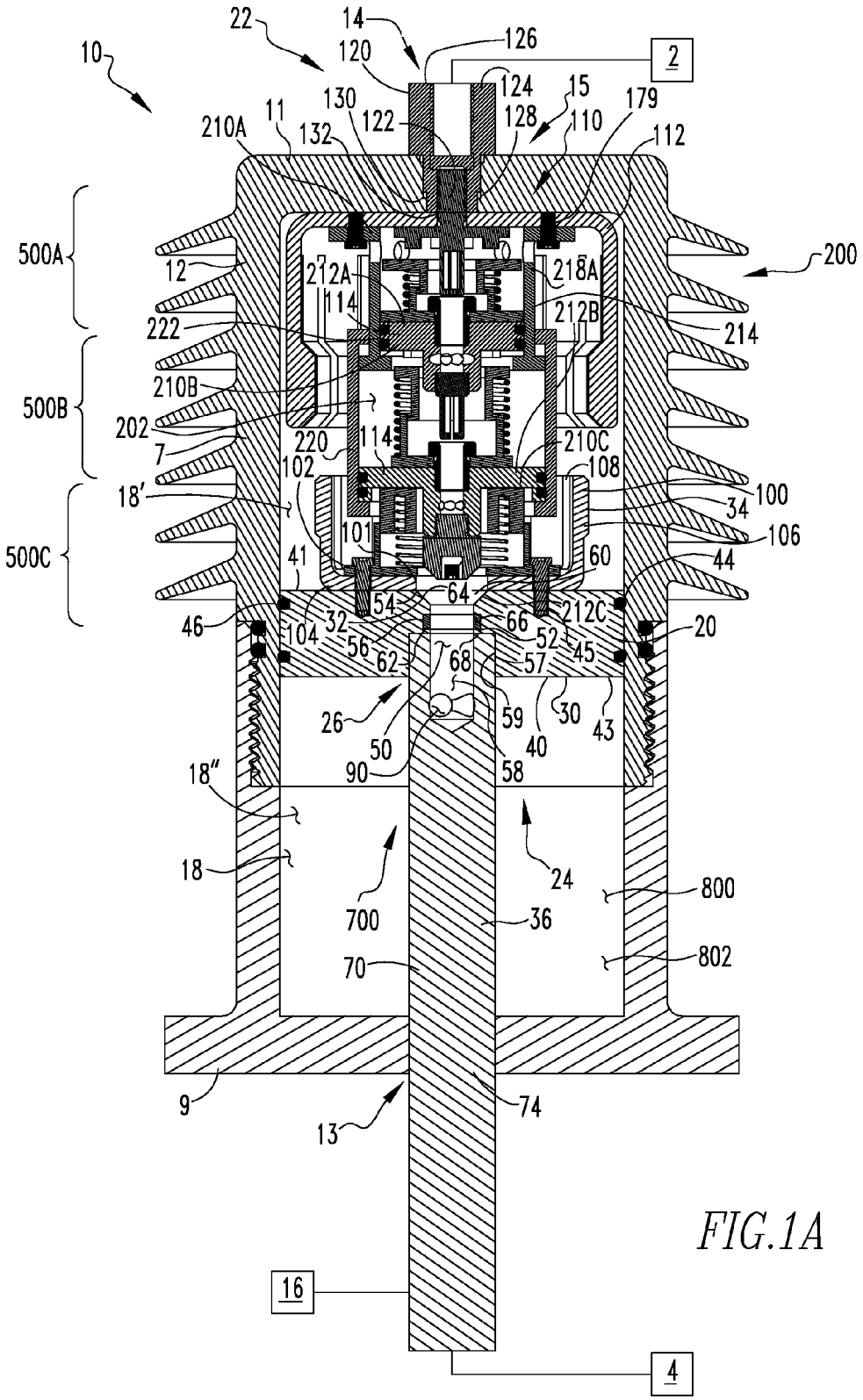
FIGS. 1A-1D are schematic cross-sectional side views of a circuit breaker. More specifically.
Figure 1B:
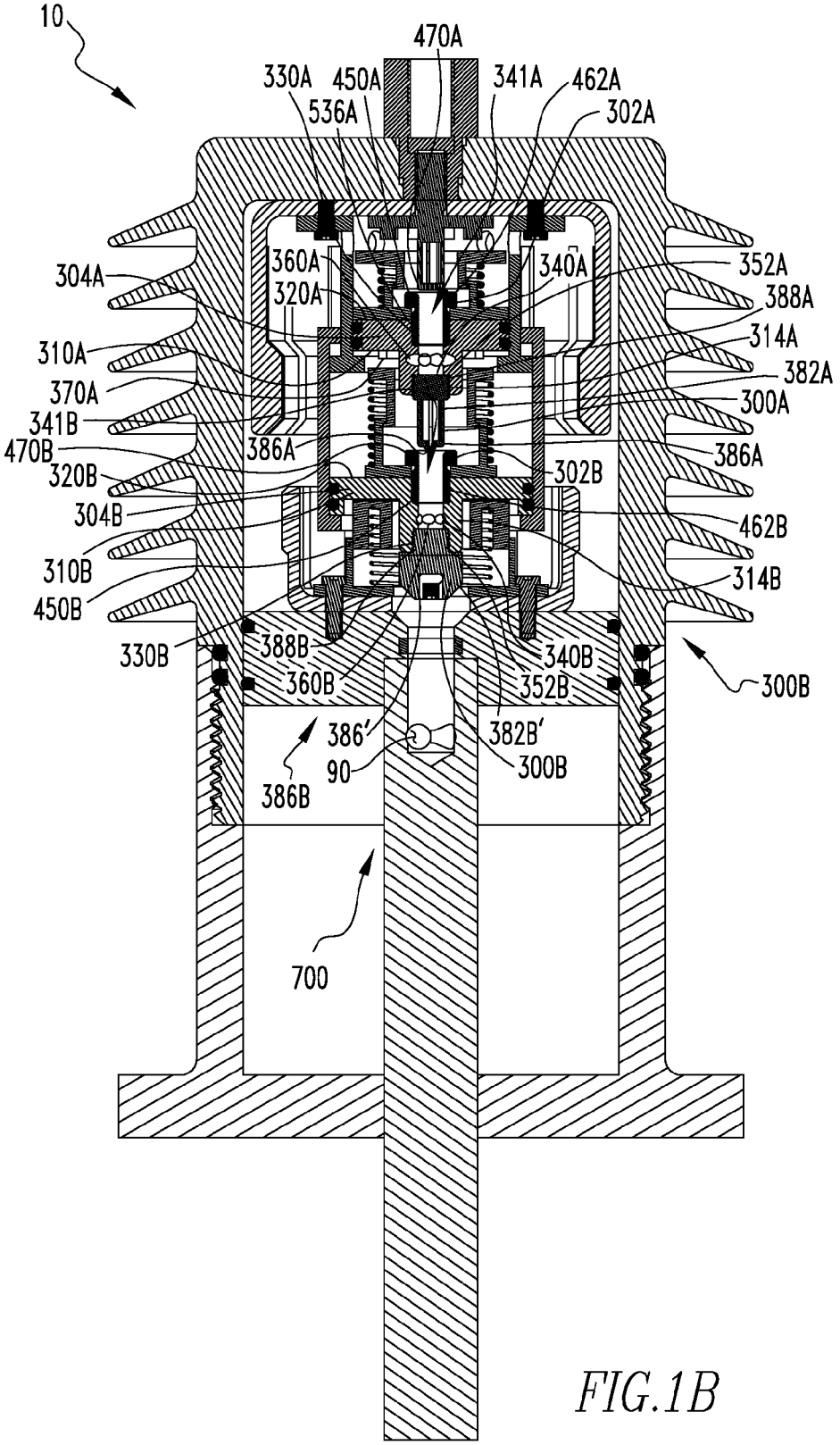
Figure 1C:
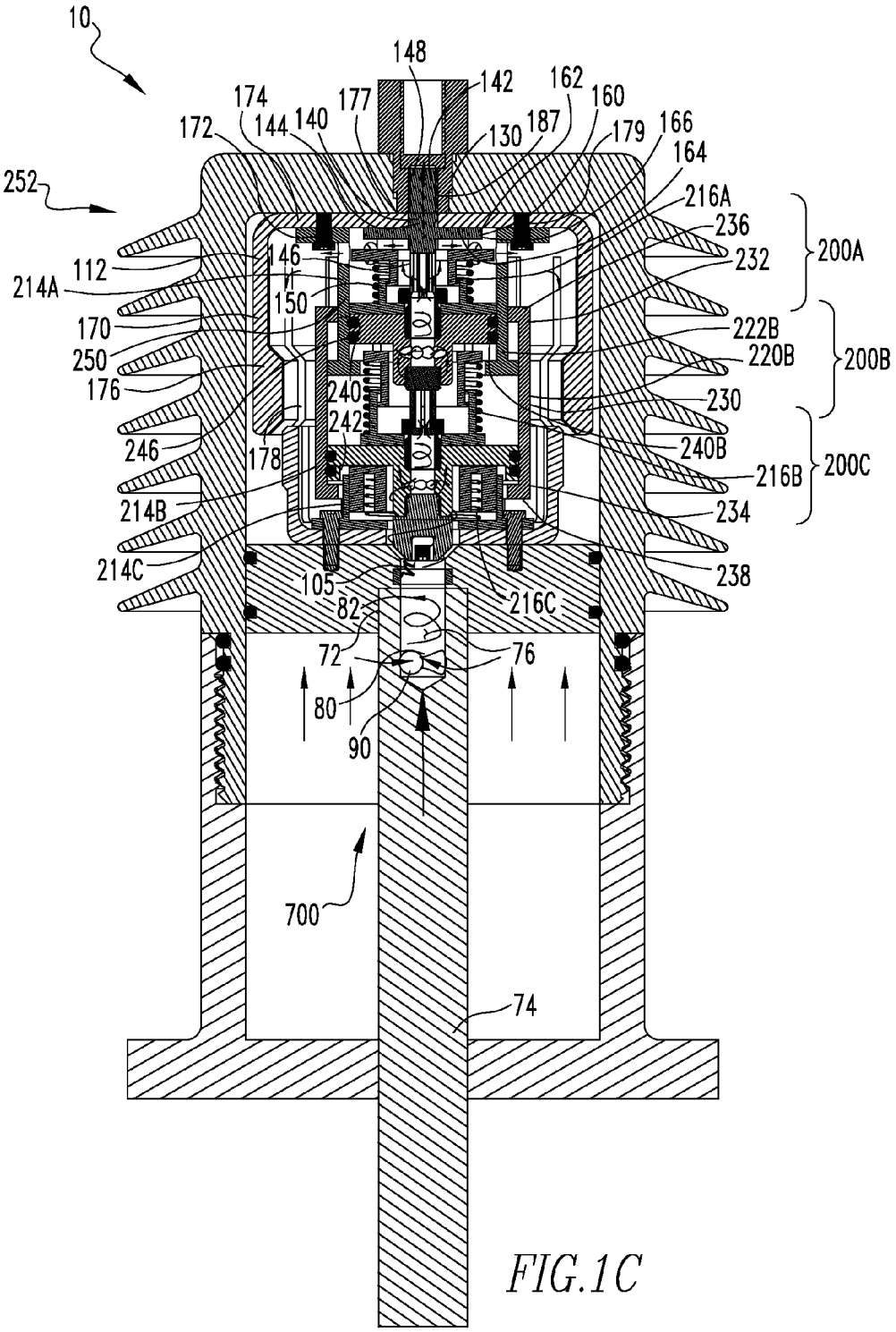
Figure 1D:
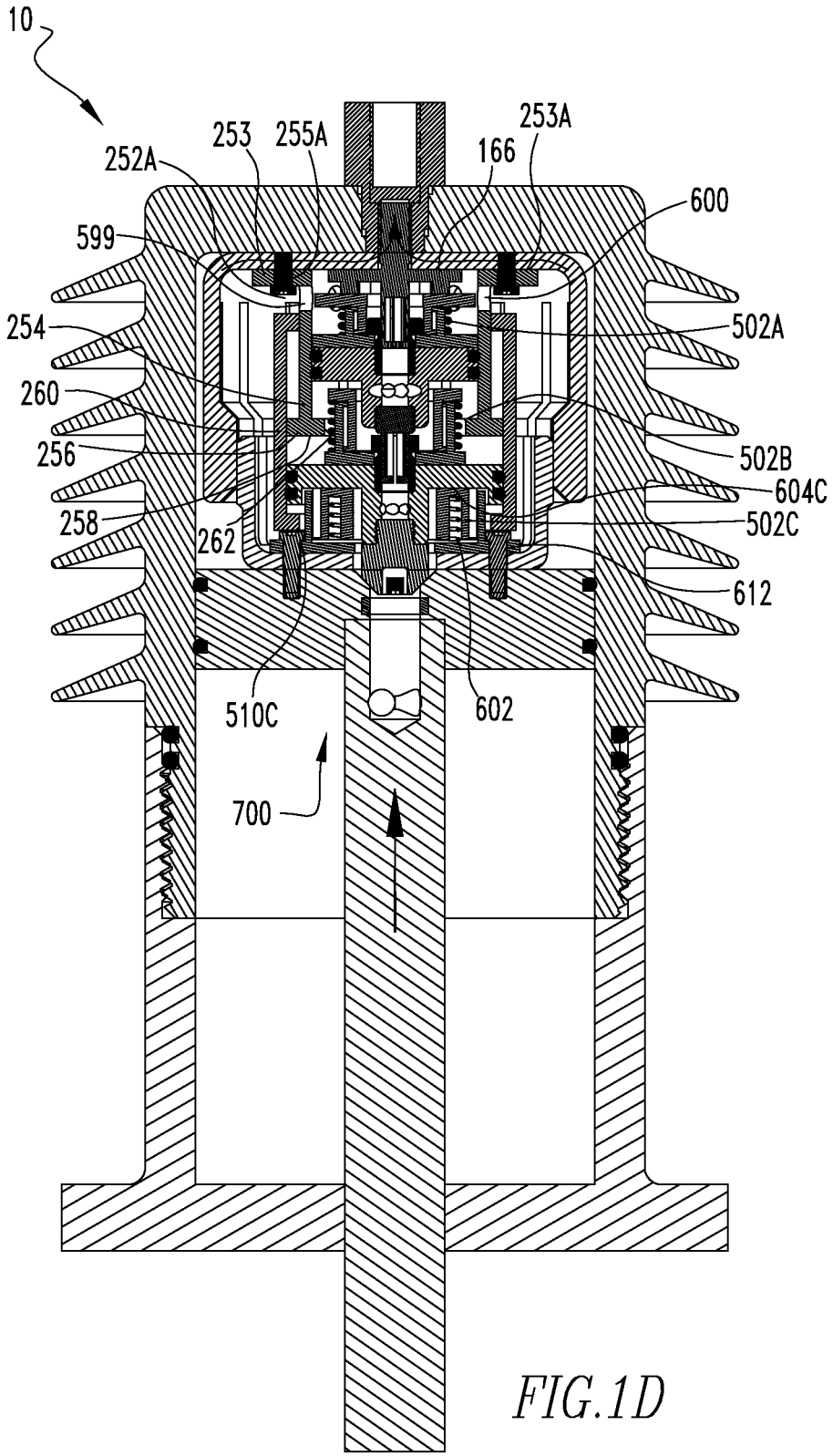

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. It is noted that moving parts, such as but not limited to circuit breaker contacts, are "directly coupled" when in one position, e.g. the closed, second position, but are not "directly coupled" when in the open, first position. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a "removable coupling assembly" means a coupling that is structured to be separated with minimal effort. As a non-limiting example, a threaded coupling is structured to be separated by rotating the elements relative to each other. A coupling such as a weld, although separable with effort, is not a "removable coupling assembly." Similarly, to be "removably coupled" means to be coupled by a "removable coupling assembly." That is, when a number of elements are "removably coupled" it means that the elements can be separated with minimal effort such as, but not limited to, decoupling a threaded coupling.

As used herein, a "removable component" is an element or assembly that is coupled to other elements by a "removable coupling assembly." For example, a threaded element that is threadably coupled to another element is a "removable component." As used herein, being a "removable component" is an inherent feature of any element or assembly that is coupled to other elements by a "removable coupling assembly."

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening is made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver operatively engages the screw and causes the screw to rotate.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, an "arcing surface" is defined by a relationship between two moving and conductive elements. "Arcing surfaces" are disposed in pairs and are those surfaces that are structured, i.e. positioned and shaped, so as to be the first two surfaces to contact each other when the two elements are brought into contact with each other.

Further, as used herein, the "conductive elements" means the entire element, or assembly, through which an electric current passes. For example, and as described below, a moving contact assembly includes a main contact assembly and an arc contact assembly; an electric current passes through the entire moving contact assembly, but the arc contact assembly is structured to contact an associated arc contact on another element. Thus, only the arc contact assembly has an "arcing surface." That is, like the main contact assembly in this example, not all elements through which an electric current passes have an "arcing surface."

As used herein, two conductive elements are "effectively spaced" when the space between the elements precludes electrical communication, including arcing. The distance between the two "effectively spaced" elements is a function of the voltage in the conductive elements. As used herein, only the arcing surfaces can be "effectively spaced."

As used herein, two conductive elements are in an "arcing position" when the two elements are spaced so that an arc forms there between. The distance between the two elements in an "arcing position" is a function of the voltage in the conductive elements. As used herein, only the arcing surfaces can be in an "arcing position."

As used herein a "fluid control port" is an opening or a passage that, alone or in conjunction with other constructs, creates a directed fluid flow, i.e. a fluid flow with an intended flow pattern. For example, a fluid passing through a hose creates a fluid flow that is, typically, aligned with the longitudinal axis of the hose; as such, the opening at the hose end is a "fluid control port." Further, certain vacuum cleaners utilize a cylindrical chamber and chamber openings in selected locations (typically in a equidistant spacing along the radial sidewall), as well as other constructs, to create a vortex in the cylinder; in the specific configuration, and in conjunction with the other constructs noted, the chamber openings are "fluid control ports." Stated alternately, a "fluid control port" is an opening or a passage that induces a directed fluid flow. A passage wherein a flow pattern forms due to other factors, such as but not limited to a low pressure zone, is not a "fluid control port." Thus, as described below, in an exemplary embodiment, the "fluid control ports" induce a vortex that creates a low pressure zone. Conversely, a bathtub drain, for example, is not structured to cause and is not intended to cause a spiral flow pattern and, as such, is not a "fluid control port." This is true even though a low pressure zone in the drain may create a vortex.

Conversely, as used herein, a "port" is an opening or a passage that does not create a directed fluid flow, i.e. a fluid flow with an intended direction or flow pattern. For example, an opening into a compressed gas cylinder (which is typically occupied by a valve) is a "port" and not a "fluid control port." That is, the flow of a gas through the opening (or valve) does not create an intended flow pattern; the gas is merely passed into the compressed gas cylinder and the flow pattern is random and/or unimportant. A "port" may, however, be a construct used in conjunction with a "fluid control port" to create an intended flow pattern. That is, a specific "port" used in conjunction with a "fluid control port" is structured to create an intended flow pattern. If, however, that same specific "port" is used in conjunction with another "port," no intended flow pattern is created. Thus, the "fluid control port" is required to create the intended flow pattern whereas the "port" is not.

As used herein, a "displaced low pressure zone" is an area, or volume, that has a lower pressure than other areas/volumes adjacent thereto. The low pressure zone is "displaced" in that the low pressure zone is not at, or immediately adjacent, a fluid control port that contributes to the formation of the "displaced low pressure zone." That is, in an exemplary embodiment, a vortex defines a low pressure zone near the axis of the vortex. A fluid control port that contributes to the formation of the vortex, however, can be spaced from the center of the vortex.

A circuit breaker assembly 10 is shown, in part, in FIGS. 1A-1D. The circuit breaker assembly 10 includes a housing assembly 12, a conductor assembly 14, and an operating mechanism 16 (shown schematically). The housing assembly 12, in an exemplary embodiment, is made from a non-conductive material. The housing assembly 12 defines an enclosed space 18. In an exemplary embodiment, and as shown in the figures, the housing assembly 12 includes a generally cylindrical sidewall 7, a lower wall 9, and an upper wall 11 which define a generally cylindrical enclosed space 18. It is understood that the housing assembly 12 and the enclosed space 18 may have other shapes.

The conductor assembly 14 includes a number of conductive members, discussed below, which are in electrical communication with a line 2 and a load 4, shown schematically. In an exemplary embodiment, any "conductive" element is made from a conductive metal such as, but not limited to, copper, aluminum, gold, silver, or platinum. As discussed in detail below, the conductor assembly 14 includes a movable contact assembly 20 and a fixed contact assembly 22. The operating mechanism 16 is operatively coupled to the movable contact assembly 20 and is structured to move the movable contact assembly 20 between an open, first position, wherein the movable contact assembly 20 is effectively spaced from the fixed contact assembly 22, and a closed, second position, wherein the movable contact assembly 20 is coupled to, and in electrical communication with, the fixed contact assembly 22. As used herein, "moving between" positions includes the movable contact assembly 20 moving from the first position to the second position and moving from the second position to the first position. That is, as used herein, "moving between" positions is not limited to movement in a single direction. It is further understood that the movable contact assembly 20 moves in one direction at a time. As detailed below, the movable contact assembly 20 and the fixed contact assembly 22 are also part of an arc extinguishing contact assembly 24. That is, the arc extinguishing contact assembly 24 is further structured to extinguish and arc.

The arc extinguishing contact assembly 24 includes the movable contact assembly 20 and the fixed contact assembly 22 as well as an arc extinguishing assembly 26 structured to extinguish an arc generated as the movable contact assembly 20 moves between the first position and the second position. That is, the arc extinguishing assembly 26 is structured to extinguish a number of arcs generated as the movable contact assembly 20 moves between the first position and the second position. In an exemplary embodiment, the arc extinguishing assembly 26 is structured to extinguish a single arc or a plurality of arcs generated as the movable contact assembly 20 moves between the first position and the second position. The local voltage of the theoretical arc of the circuit breaker assembly 10 is reduced by dividing the theoretical arc into multiple local arcs. That is, as used herein, the "theoretical arc" of the circuit breaker assembly 10 is the voltage of an arc that would exist if the circuit breaker assembly 10 generated a single arc. As used herein, a "local arc" is one of a plurality of arcs, i.e. more than one arc, that result from a configuration wherein multiple arcs are generated as the movable contact assembly 20 moves between the first position and second position.

A number of elements of the various assemblies 20, 22, and 26 serve more than one purpose; thus for example, an element such as an intermediate second arc contact assembly 450, discussed below, is part of both the conductor assembly 14 and the arc extinguishing assembly 26. That is, although an element may be introduced as part of one assembly, that element may also be a part of another assembly, as discussed below. It is further noted that the fixed contact assembly 22 includes a number of movable intermediate arc contact assemblies 114. It is understood that, as used herein, the "fixed contact assembly" 22 includes a fixed arc contact assembly 110 and a fixed main contact assembly 112, but also includes the movable intermediate arc contact assemblies 114. That is, the term "fixed contact" does not limit the fixed contact assembly 22 to exclusively fixed contacts so long as at least one contact is fixed.

Figure 2:
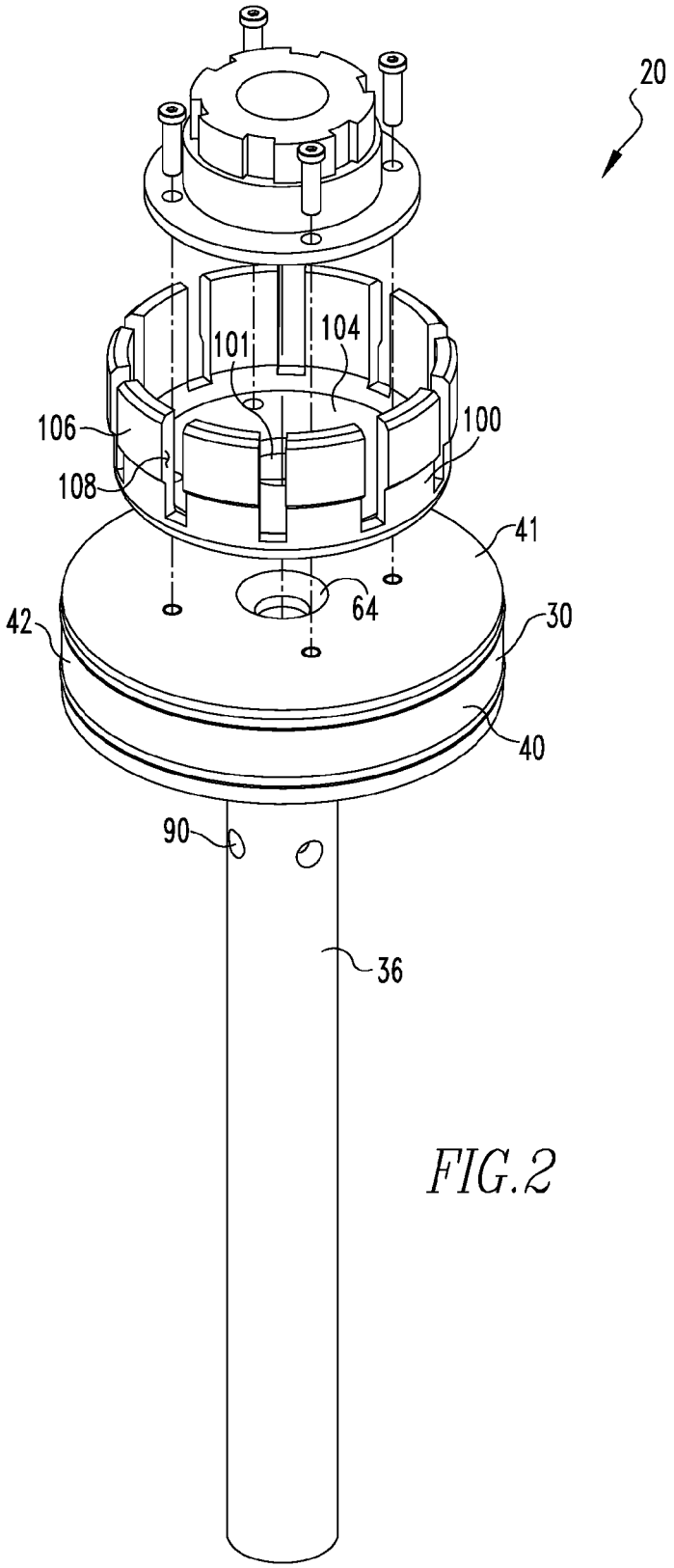
FIG. 2 is a schematic isometric view of the movable contact assembly.

The movable contact assembly 20, also shown in FIG. 2 includes a moving support member 30, an arc contact assembly 32, a main contact assembly 34, and a stem 36. The movable contact assembly support member 30 includes a conductive, generally toroidal body 40 having an outer cross-sectional shape corresponding to the shape of the housing assembly enclosed space 18 and, in an exemplary embodiment, substantially corresponding to the shape of the housing assembly enclosed space 18. Thus, in an exemplary embodiment, the movable contact assembly support member body 40 is generally circular. Further, the moving support member 30 is structured to act, and does act, as a piston, as described below.

In an exemplary embodiment, the movable contact assembly support member body 40 includes an upper side 41 and a lower side 43. The movable contact assembly support member body 40 is also elongated axially and includes a radial surface 42. The movable contact assembly support member body radial surface 42 includes a number of grooves 44 (FIG. 1) structured to accept sealing members 46 such as, but not limited to, O-rings. In this configuration, and when the movable contact assembly support member body 40 is disposed in the housing assembly enclosed space 18, the movable contact assembly support member body sealing member 46 sealingly engages, directly or indirectly, the housing assembly 12. The movable contact assembly support member body upper side 41 includes threaded bores 45.

Further, the movable contact assembly support member body 40 defines a central passage 50 including a radial inner surface 52. The movable contact assembly support member body passage 50 is part of the movable contact assembly arc contact assembly 32, as described below. The movable contact assembly support member body passage 50 includes an upper portion 54, a medial portion 56, and a lower portion 58. The movable contact assembly support member body passage upper portion 54 is, in an exemplary embodiment, tapered. That is, the movable contact assembly support member body passage upper portion 54 includes an upper end 60 and a lower end 62 wherein the movable contact assembly support member body passage upper portion 54 is wider at the upper end 60 than at the lower end 62. In an exemplary embodiment, the taper of the movable contact assembly support member body passage upper portion 54 is between about 1 degree and 89 degrees, or about 45 degrees relative to a vertical line. The movable contact assembly support member body passage upper portion 54 is an arcing surface 64, as described below. Further, the movable contact assembly support member body passage upper portion 54 is also part of the arc extinguishing assembly 26 as discussed below.

The movable contact assembly support member body passage medial portion 56, in an exemplary embodiment, includes an arc attracting metal such as, but not limited to, Hafnium, Tungsten, Zirconium, Niobium, Molybdenum and Tantalum (from refractory metal family) or, Copper, Silver, Gold (Noble Metals) or, Titanium, Vanadium, Chromium, Palladium, Yttrium, Platinum (Transition metal family) or, Lanthanum, Neodymium (Non-radioactive Lanthanoides family). That is, the movable contact assembly support member body passage medial portion 56 has a generally constant radius except for a circumferential groove 66. Within the circumferential groove 66 is an arc attracting metal toroidal band 68. Arc attracting materials are discussed below. In an exemplary embodiment, the band 68 has an inner radius that is generally similar to the radius of the movable contact assembly support member body passage medial portion 56. Thus, when the band 68 is in place, the inner surface of the movable contact assembly support member body passage medial portion 56 is generally smooth. It is noted that the band 68 is also part of the arc extinguishing assembly 26, as discussed below.

The movable contact assembly support member body passage lower portion 58 is structured to be coupled to the stem 36. In an exemplary embodiment, the movable contact assembly support member body passage lower portion 58 is structured to be removably coupled to the stem 36. For example, in an exemplary embodiment, the movable contact assembly support member body passage lower portion 58 includes threads 57.

The stem 36 includes an elongated, conductive, generally cylindrical body 70. The stem body 70 includes an upper portion 72 and a lower portion 74. The stem body lower portion 74 is structured to pass through a lower opening 13 in the housing assembly lower wall 9. That is, the stem body lower portion 74 is sized to correspond to the housing assembly lower opening 13. Further, a number of sealing members (not shown) may be disposed in the housing assembly lower opening 13 to reduce or eliminate the passage of fluid through the housing assembly lower opening 13. As shown schematically in FIG. 1A, the stem body lower portion 74 is operatively coupled to the operating mechanism 16. Further, the stem body lower portion 74 is coupled to, and in electrical communication with, one of the line or load 2, 4. The outer surface of the stem body upper portion 72, in an exemplary embodiment, includes threads 59. The stem body upper portion threads 59 are configured to correspond to the movable contact assembly support member body passage lower portion threads 57. In this configuration, the stem 36 is structured to be removably coupled to the moving support member 30 by coupling the stem body upper portion threads 59 and the movable contact assembly support member body passage lower portion threads 57.

Further, the stem body upper portion 72 defines an axial bore 76. The stem body upper portion bore 76, in an exemplary embodiment, is disposed generally axially on the stem body 70 and extends between about 0.1 inch and 10.0 inches, or about 2.0 inches. The stem body upper portion bore 76 includes a first end 80 and a second end 82. The stem body upper portion bore second end 82 is disposed at the axial surface of the stem body 70. The stem body upper portion bore first end 80 is disposed at the end of the stem body upper portion bore 76 opposite the stem body upper portion bore second end 82. A fluid control port 90, hereinafter the "stem body fluid control port 90," is disposed at, and is in fluid communication with, stem body upper portion bore first end 80. As such, the stem body upper portion bore 76 is, as used herein, a "passage." That is, as used herein, the stem body upper portion bore 76 is also identified as the "stem body upper portion passage 76" or may be generally identified as a "passage." The stem body upper portion passage 76 and the stem body fluid control port 90 are also part of the arc extinguishing assembly 26, as discussed below.

The movable contact assembly main contact assembly 34, hereinafter "movable main contact assembly 34," includes a conductive main contact body 100 and a number of coupling devices, as shown, movable main contact assembly body openings 101 and threaded fasteners 102. The movable main contact assembly body 100 is, in an exemplary embodiment, generally bowl-shaped. That is, the movable main contact assembly body 100 includes a generally planar base portion 104 and a depending sidewall 106. The movable main contact assembly body base portion 104, in an exemplary embodiment, is generally circular and includes a central opening 105. The movable main contact assembly body depending sidewall 106 extends generally perpendicular to the movable main contact assembly body base portion 104. The movable main contact assembly body depending sidewall 106, in an exemplary embodiment, includes a number of elongated slots 108 extending in a generally axial direction, i.e. generally perpendicular to the movable main contact assembly body base portion 104. In this configuration, the movable main contact assembly body depending sidewall 106 is divided into a number of "fingers" that are structured to flex radially relative to the movable main contact assembly body base portion 104. In an exemplary embodiment, the outer distal edge of the movable main contact assembly body depending sidewall 106 is beveled. In an exemplary embodiment, the movable main contact assembly body 100 is a unitary body. As is known, the movable main contact assembly 34 is also identified as a "cluster finger assembly." Further, as is known, when the movable contact assembly main contact assembly 34 is in the second position, the main flow of the electric current is via the movable contact assembly main contact assembly 34 and the fixed main contact assembly 112, discussed below. The elements of the main contact assemblies 34, 112 have more surface area and contact pressure allowing these assemblies to conduct electric current for longer time. The arc contact assemblies, e.g. movable contact assembly arc contact assembly 32 and others discussed below, conduct electricity primarily during the arcing period, and thereafter minimally during normal operation when the movable main contact assembly 34 is in the second position.

The fixed contact assembly 22 includes an arc contact assembly 110, a main contact assembly 112, and a number of movable, intermediate arc contact assemblies 114. The fixed contact assembly arc contact assembly, hereinafter "fixed arc contact assembly 110," includes a conductive base member 120 and a conductive insert 122. The fixed arc contact assembly base member 120, in an exemplary embodiment, includes an elongated, generally cylindrical conductive body 124. The fixed arc contact assembly base member body 124 includes a first end 126 and a second end 128. The fixed arc contact assembly base member body 124 is structured to pass through an upper opening 15 in the housing assembly upper wall 11. That is, the fixed arc contact assembly base member body 124 is sized to correspond to the housing assembly upper opening 15. Further, a number of sealing members 130 may be disposed in the housing assembly upper opening 15 to reduce or eliminate the passage of fluid through the housing assembly upper opening 15. The fixed arc contact assembly base member body first end 126 is disposed outside the housing assembly enclosed space 18 and is structured to be coupled to, and in electrical communication with, a line or a load 2, 3 (shown schematically). The fixed arc contact assembly base member body second end 128 is disposed within, or adjacent to, the housing assembly enclosed space 18. The fixed arc contact assembly base member body second end 128 includes a removable coupling; as shown, a threaded bore 132.

The fixed arc contact assembly conductive insert 122 includes an elongated body 140. The fixed arc contact assembly conductive insert body 140 includes a first end 142, a medial portion 144, and a second end 146. The arc contact assembly conductive insert body first end 142 includes a removable coupling; as shown, external threads 148 sized to correspond to the fixed arc contact assembly base member body second end threaded bore 132. The distal end of the fixed arc contact assembly conductive insert body second end 146, i.e. the portion of the fixed arc contact assembly conductive insert body second end 146 furthest from the fixed arc contact assembly conductive insert body first end 142, includes an arcing surface 150.

In an exemplary embodiment, the fixed arc contact assembly conductive insert body medial portion 144 includes a generally planar, generally radially extending circular flange 160. The fixed arc contact assembly conductive insert body flange 160 includes an upper surface 162 and a lower surface 164. The fixed arc contact assembly conductive insert body flange lower surface 164 includes a segmented collar 166. The fixed arc contact assembly conductive insert body flange segmented collar 166 is, in an exemplary embodiment, a toroidal ridge having gaps therein. The fixed arc contact assembly conductive insert body flange segmented collar 166 assists in directing fluid flow. That is, the fixed arc contact assembly conductive insert body flange segmented collar 166 is part of the arc extinguishing assembly 26, as discussed below.

The fixed contact assembly main contact assembly 112, hereinafter the "fixed main contact assembly 112," includes a conductive main contact body 170 and a number of coupling devices, as shown, threaded fasteners 172. The fixed main contact assembly body 170 is, in an exemplary embodiment, generally bowl-shaped. That is, the fixed main contact assembly body 170 includes a generally planar base portion 174 and a depending sidewall 176. The fixed main contact assembly body base portion 174, in an exemplary embodiment, is generally circular and includes a central opening 177 as well as a number of threaded openings 179 disposed radially thereabout. The fixed main contact assembly body depending sidewall 176 extends generally perpendicular to the fixed main contact assembly body base portion 174. In an exemplary embodiment, the inner distal edge of the fixed main contact assembly body depending sidewall 176 is beveled. The fixed main contact assembly body depending sidewall 180, in an exemplary embodiment, includes a number of elongated slots 178 extending in a generally axial direction, i.e. generally perpendicular to the fixed main contact assembly body base portion 174. In this configuration, the fixed main contact assembly body depending sidewall 176 is divided into a number of "fingers" that are structured to flex radially relative to the fixed main contact assembly body base portion 174. Further, the inner radius of the fixed main contact assembly body depending sidewall 176 corresponds to, or snuggly corresponds to, the outer radius of the movable main contact assembly body depending sidewall 106. In this configuration, the movable main contact assembly body depending sidewall 106 is structured to move into the space defined by the fixed main contact assembly body depending sidewall 176 while making contact with the fixed main contact assembly body depending sidewall 176. In such a configuration, the movable main contact assembly body 100 and the fixed main contact assembly body 170 would be in electrical communication. In an exemplary embodiment, the fixed main contact assembly body 170 is a unitary body.

The intermediate arc contact assemblies 114 are part of a number of collapsible chambers 200. Each collapsible chamber 200 defines a substantially enclosed space 202 wherein the chamber enclosed space 200 has a variable volume. Each collapsible chamber 200 is also part of the arc extinguishing assembly 26. While there can be any number of collapsible chambers 200, in the exemplary embodiment shown, there are three; an upper, first collapsible chamber 200A, a medial, second collapsible chamber 200B, and a lower, third collapsible chamber 200C. As shown, the third collapsible chamber 200C does not define a chamber 200 until the movable contact assembly 20 is adjacent the fixed contact assembly 22; that is, in, or about to be in, the second position. It is understood that, and as used herein, a "collapsible chamber" changes configuration between an expanded, first configuration having a chamber enclosed space 200 with a greater volume and a collapsed, second configuration having a chamber enclosed space 200 of a lesser volume. It is further understood, and as used herein, that a "collapsible chamber" collapses when moving from the first configuration to the second configuration. Further, it is understood that, and as used herein, a "collapsible chamber" can move from the second configuration to the first configuration; thus a "collapsible chamber" is also an "expandable chamber" when moving from the second configuration to the first configuration.

The collapsible chambers 200 include similar elements and a generic collapsible chamber 200 (i.e. a reference number without any subsequent letter) will be described. When an element is specific to a certain collapsible chamber 200A, 200B, 200C, the element will be identified by a reference number followed by the associated collapsible chamber letter. Similarly, if a specific embodiment of an element is shown in association with certain collapsible chamber 200A, 200B, 200C, the element will be identified by a reference number followed by the associated collapsible chamber letter.

A collapsible chamber 200 may utilize any collapsible configuration, such as, but not limited to a chamber including a bellows or an accordion-like sidewall (neither shown). In an exemplary embodiment, as shown in the figures and as described below, a collapsible chamber 200 includes both movable end walls and/or telescoping sidewalls. That is, for example, a collapsible chamber 200 includes an upper, first end wall 210, a lower, second end wall 212 and a sidewall assembly 214. The collapsible chamber 200 changes between the first and second configuration by having the first end wall 210 and the second end wall 212 move closer together (collapsing) or farther apart (expanding). In an exemplary embodiment, each collapsible chamber 200 also includes positioning assembly 216 structured to move the associated collapsible chamber 200 from at least one configuration to the other configuration at a synchronized rate, as discussed below. As with the housing assembly 12, in an exemplary embodiment, a collapsible chamber 200 is generally cylindrical. Thus, the sidewall assembly 214 is generally cylindrical.

In an exemplary embodiment, at least one of the first end wall 210 and the second end wall 212 is movable relative to an associated sidewall assembly 214. That is, at least one of the first end wall 210 and the second end wall 212 is not fixed to the associated sidewall assembly 214. Elements of an intermediate arc contact assembly 114 form at least one of the first end wall 210 and the second end wall 212 in each collapsible chamber 200. Before discussing the end walls 210, 212, the configuration of one embodiment of the sidewall assembly 214 will be discussed.

The upper, first collapsible chamber 200A and the lower, third collapsible chamber 200C are unique in that the first collapsible chamber 200A is directly coupled to the housing assembly 12, and, the third collapsible chamber 200C is directly coupled to the movable contact assembly 20; in the disclosed embodiment, there is a single medial, second collapsible chamber 200B. It is understood, however, that there may be any number of medial, second collapsible chambers 200.

Any medial collapsible chamber 200B, in an exemplary embodiment, utilizes telescoping sidewalls. That is, the sidewall assembly 214 includes an outer sidewall member 220 and an inner sidewall member 222 disposed in a telescopic relationship. That is, the outer sidewall member 220 has an inner radius that generally corresponds to the outer radius of the inner sidewall member 222. It is understood that if the collapsible chamber 200 has a shape other than generally cylindrical, the outer sidewall member 220 and inner sidewall member 222 have a corresponding shape wherein the cross-sectional area of the outer sidewall member 220 is slightly larger than the cross-sectional area of the inner sidewall member 222. In this configuration, the inner sidewall member 222 is structured to be, and is, slidably disposed within the outer sidewall member 220.

Further, it is understood that the telescoping elements are disposed in series along a common longitudinal axis and that adjacent medial collapsible chambers 200B share elements. That is, for example, the outer sidewall member 220 one medial collapsible chamber 200B is the inner sidewall member 222 of an adjacent, lower medial collapsible chamber 200B. It is understood that in the exemplary embodiment shown, the upper, first collapsible chamber 200A includes a fixed sidewall 218A that is also the sidewall assembly inner sidewall member 222 of the medial, second collapsible chamber 200B. That is, this specific sidewall serves two purposes and is identified by two reference numbers 218, 222 depending upon which collapsible chamber 200 is being discussed. The following discusses a generic medial collapsible chamber 200B having a telescoping sidewall assembly sidewall assembly 214.

In an exemplary embodiment, the sidewall assembly outer sidewall member 220 includes a hollow, generally cylindrical body 230. The outer sidewall member body 230 includes an upper, first end 232 and a lower, second end 234. Further, in an exemplary embodiment, the outer sidewall member body 230 includes an upper, inwardly extending flange 236 disposed at the outer sidewall member body first end 232, and a lower, inwardly extending flange 238 disposed at the outer sidewall member body second end 234. In an exemplary embodiment, each outer sidewall member body flange 236, 238 is generally planar and includes a radial, inner surface 240, 242. In an exemplary embodiment, sealing members 246, such as, but not limited to O-rings, are disposed on an outer sidewall member body flange inner surface 240, 242 if that outer sidewall member body flange inner surface 240, 242 is disposed against another sidewall assembly member 220, 222; that is, against another sidewall assembly member 220, 222 that is part of the associated sidewall assembly 214 or an adjacent sidewall assembly 214.

In an exemplary embodiment, the sidewall assembly inner sidewall member 222 includes a hollow, generally cylindrical body 250. The inner sidewall member body 250 includes an upper, first end 252 and a lower, second end 254. The inner sidewall member body second end 254 includes a lower, outwardly extending flange 256. Further, if the inner sidewall member 222 supports elements of an intermediate arc contact assembly 114, as described below, the inner sidewall member body second end 254 may include a lower, inwardly extending flange 258. In this embodiment, generally, the inner sidewall member body second end 254 has a "T" shaped cross-section. In an exemplary embodiment, each inner sidewall member body flange 256, 258 is generally planar and includes a radial outer surface 260 and a radial inner surface 262. In an exemplary embodiment, sealing members (not shown), such as, but not limited to O-rings, are disposed on an inner sidewall member body flange surface 260 if that inner sidewall member body flange outer surface 260 is disposed against another sidewall assembly member 220, 222; that is, against another sidewall assembly member 220, 222 that is part of the associated sidewall assembly 214 or an adjacent sidewall assembly 214.

Generally, when assembled, the sidewall assembly inner sidewall member 222 is slidably disposed within the sidewall assembly outer sidewall member 220. In an exemplary embodiment, the sidewall assembly outer sidewall member flange inner surface 240, 242, or the sealing member 246, is sealingly engage with the associated sidewall assembly inner sidewall member 222. Similarly, the sidewall assembly inner sidewall member body flange outer surface 260, or the sealing members (not shown), sealingly engage with the associated sidewall assembly outer sidewall member 220. In this configuration, each associated pair of sidewall assembly outer sidewall members 220 and sidewall assembly inner sidewall members 222 are telescopically coupled and are structured to move between an expanded, first configuration and a collapsed, second configuration.

As noted above, elements of the intermediate arc contact assemblies 114 are part of a number of, and more specifically adjacent, collapsible chambers 200 and, more specifically, define one of the collapsible chamber first end wall 210 and the second end wall 212. As is known, elements that are telescopically coupled are disposed in series. That is, a longitudinal axis extends through the telescopically coupled elements and, in an expanded configuration, one telescopic element is longitudinally offset relative to the adjacent telescopic element. The collapsible chamber 200A, 200B, 200C disclosed herein are also disposed in series; i.e. along a common longitudinal axis. In this configuration, and with the exception of the uppermost first end wall 210A and the lowermost second end wall 212C, the upper, first end wall 210B of one collapsible chamber, for example medial second collapsible chamber 200B, is also the lower, second end wall 212A of the adjacent upper collapsible chamber 200A. That is, it is understood that elements of the intermediate arc contact assemblies 114 are both the upper, first end wall 210 of one collapsible chamber 200 as well as the lower, second end wall 212 of the adjacent collapsible chamber 200.

Figure 3:
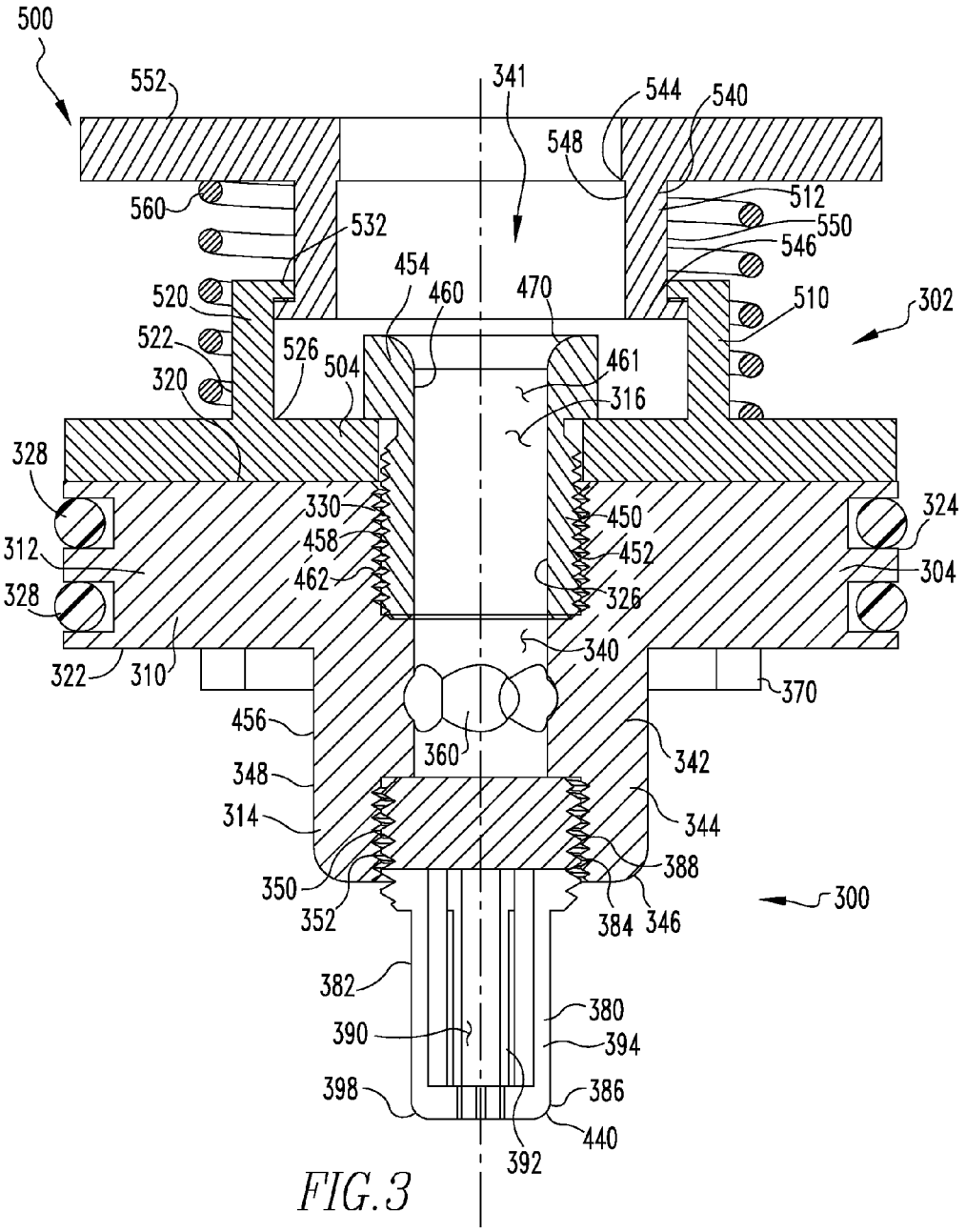
FIG. 3 is a schematic cross-sectional view of an intermediate arc contact assembly.
Figure 4:
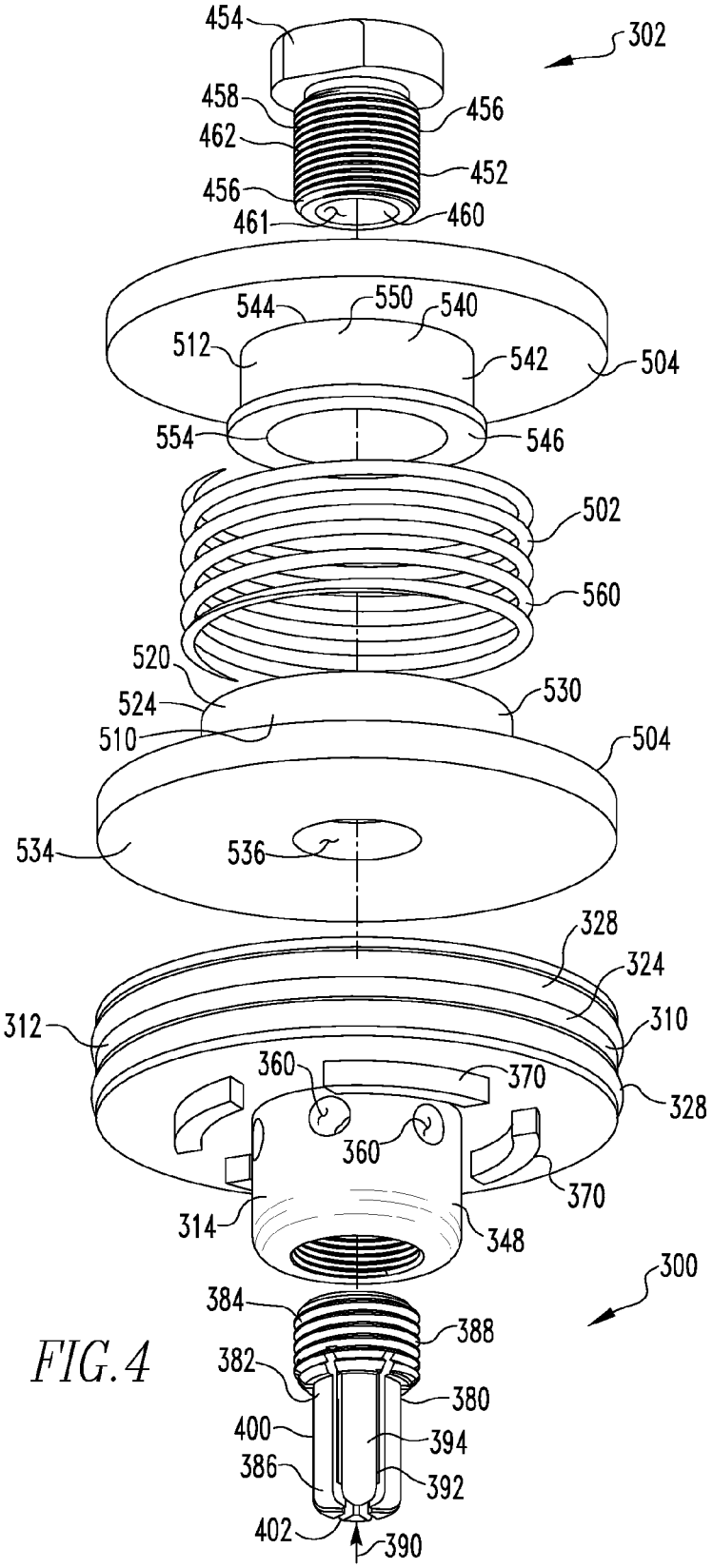
FIG. 4 is a schematic exploded isometric view of an intermediate arc contact assembly.

The intermediate arc contact assemblies 114 are generally similar and only one will be described initially. As with the collapsible chambers 200A, 200B, 200C, specific elements will subsequently be identified with a letter (A, B, or C) as needed. As shown in FIGS. 3 and 4, an intermediate arc contact assembly 114 includes a first arc contact assembly 300, a second arc contact assembly 302, and a support member 304. Each intermediate arc contact assemblies 114 generates at least one local arc, as discussed below. It is noted that having a plurality of local arc aids in extinguishing the arcs. As such, the intermediate arc contact assemblies 114 are part of the arc extinguishing assembly 26.

The intermediate arc contact assembly support member 304 includes a conductive body 310. In an exemplary embodiment, the intermediate arc contact assembly support member conductive body 310 includes a wide portion 312 and a narrow portion 314. The intermediate arc contact assembly support member conductive body wide portion 312 is generally planar, generally circular and includes a central passage 316, i.e. a torus. The intermediate arc contact assembly support member conductive body wide portion 312 is sized to correspond to an associated sidewall assembly member 220, 222, as described below. The intermediate arc contact assembly support member conductive body wide portion 312 includes an upper surface 320, a lower surface 322, a radial, outer surface 324, and a radial inner surface 326. The intermediate arc contact assembly support member conductive body wide portion outer surface 324, in an exemplary embodiment, includes sealing members 328, such as, but not limited to O-rings. The intermediate arc contact assembly support member conductive body wide portion inner surface 326, in an exemplary embodiment, includes threads 330.

The intermediate arc contact assembly support member conductive body narrow portion 314 is generally planar, generally circular and includes a central passage 340, i.e. the intermediate arc contact assembly support member conductive body narrow portion 314 is generally a torus. The intermediate arc contact assembly support member conductive body wide portion central passage 316 and the intermediate arc contact assembly support member conductive body narrow portion passage 340 are contiguous, that is, in fluid communication with each other, and are hereinafter collectively identified as the "intermediate arc contact assembly axial passage 341." The intermediate arc contact assembly support member conductive body narrow portion 314 includes an upper, first end 342, a medial portion 344, a lower, second end 346, an outer surface 348 and an inner surface 350. In an exemplary embodiment, the intermediate arc contact assembly support member conductive body wide portion 312 and the intermediate arc contact assembly support member conductive body narrow portion 314 are a unitary body. That is, the intermediate arc contact assembly support member conductive body narrow portion first end 342 is unitary with the intermediate arc contact assembly support member conductive body wide portion lower surface 322. The intermediate arc contact assembly support member conductive body narrow portion medial portion 344 includes a number of spiral passages, hereinafter identified as "intermediate arc contact assembly fluid control port 360." The intermediate arc contact assembly fluid control port(s) 360 are part of the arc extinguishing assembly 26, as discussed below. The intermediate arc contact assembly support member conductive body narrow portion second end 346 also includes threads 352 on the inner surface 350.

In an exemplary embodiment, the intermediate arc contact assembly support member conductive body wide portion lower surface 322 includes a segmented collar 370. The intermediate arc contact assembly support member conductive body segmented collar 370 is, in an exemplary embodiment, a toroidal ridge having gaps therein. The intermediate arc contact assembly support member conductive body segmented collar 370 extends about, and is spaced from, the intermediate arc contact assembly support member conductive body narrow portion 314; that is, the inner radius of the intermediate arc contact assembly support member conductive body segmented collar 370 is greater than the radius of the intermediate arc contact assembly support member conductive body narrow portion 314. The intermediate arc contact assembly support member conductive body segmented collar 370 assists in directing fluid flow. That is, the intermediate arc contact assembly support member conductive body segmented collar 370 is part of the arc extinguishing assembly 26, as discussed below. It is noted that an intermediate arc contact assembly support member conductive body segmented collar 370 is not required and the lack of an intermediate arc contact assembly support member conductive body segmented collar 370 allows the chambers 200A, 200B, 200C to form without fluid flow paths other than through the intermediate arc contact assembly fluid control ports 360, as described below.

Each intermediate arc contact assembly first arc contact assembly 300 includes a conductive insert 380. Hereinafter, the term "intermediate arc contact assembly first arc contact assembly" shall be reduced to "intermediate first arc contact assembly." Each intermediate first arc contact assembly conductive insert 380 includes an elongated body 382 having a proximal, first end 384 and a distal, second end 386. Each intermediate first arc contact assembly conductive insert body first end 384 is generally cylindrical and includes threads 388 on the outer radial surface. There are at least two embodiments of the intermediate first arc contact assembly conductive insert body 382, 382' (discussed below). In a first embodiment, the intermediate first arc contact assembly conductive insert body second end 386 includes an axial bore 390 and a number of axial slots 392. In this configuration, the intermediate first arc contact assembly conductive insert body second end 386 defines a number of "fingers" 394. The intermediate first arc contact assembly conductive insert body second end 386 includes a rounded, or beveled, arcing surface 398. That is, at the intermediate first arc contact assembly conductive insert body second end 386, the transition between an outer radial surface 400 and an axial surface 402 is rounded, or beveled and is an arcing surface 398. This arcing surface may be described alternately as the "intermediate first arc contact assembly conductive insert body arcing surface 398," or the "intermediate first arc contact assembly arcing surface 398." As described below, this is the surface where an arc will form.

Figure 5:
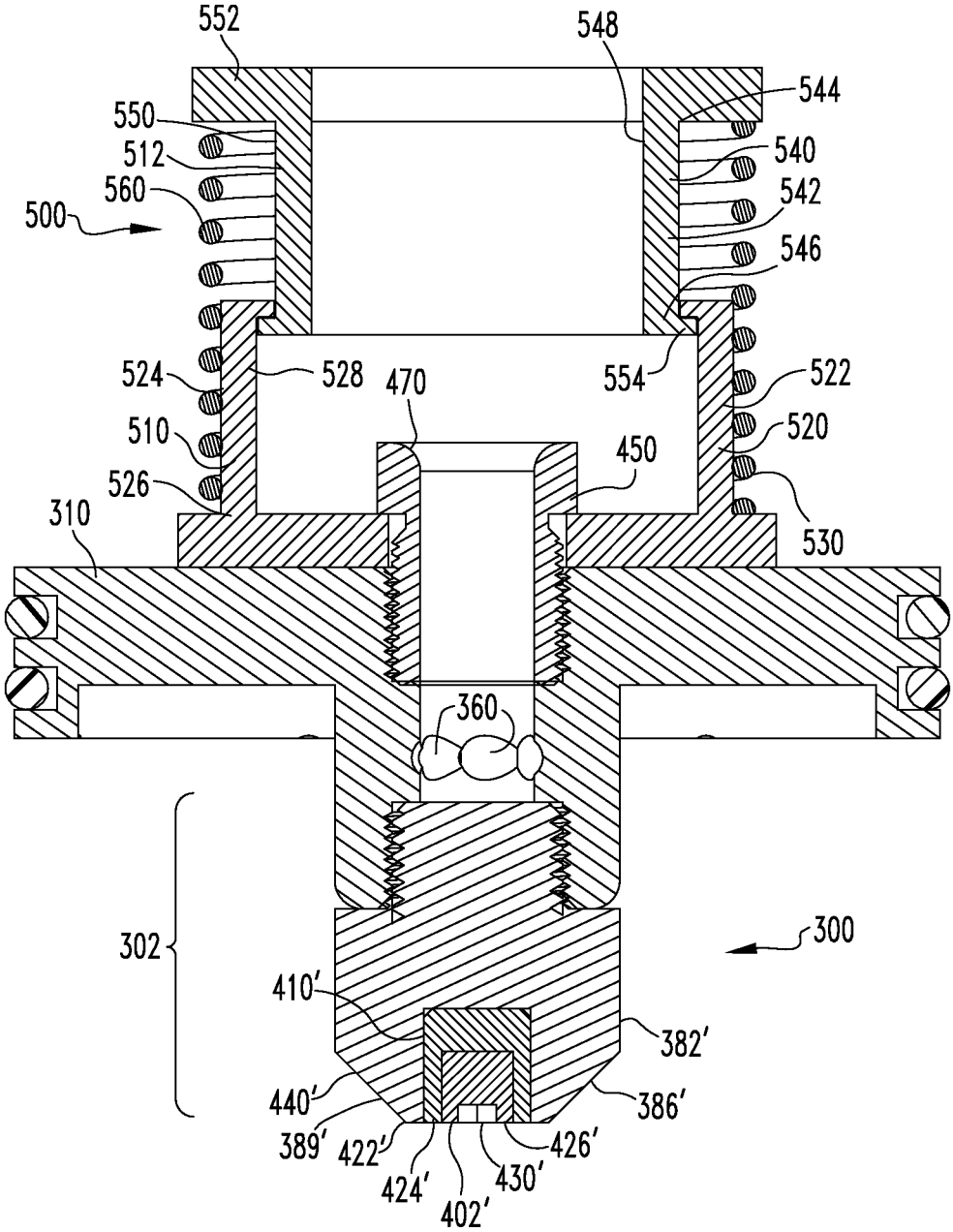
FIG. 5 is a schematic cross-sectional view of an alternate embodiment intermediate arc contact assembly.
Figure 6:
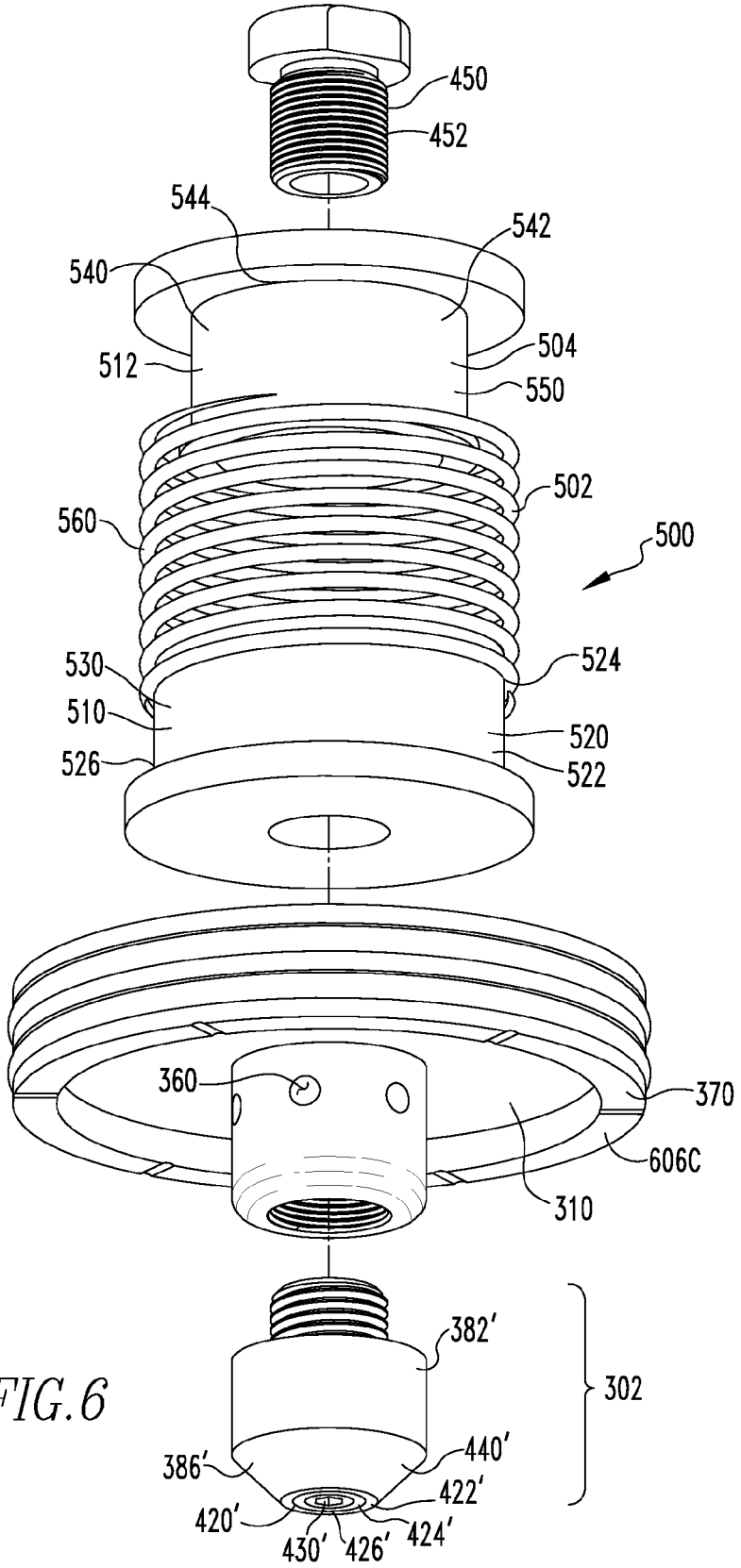
FIG. 6 is a schematic exploded isometric view of an alternate embodiment intermediate arc contact assembly.
Figure 7:
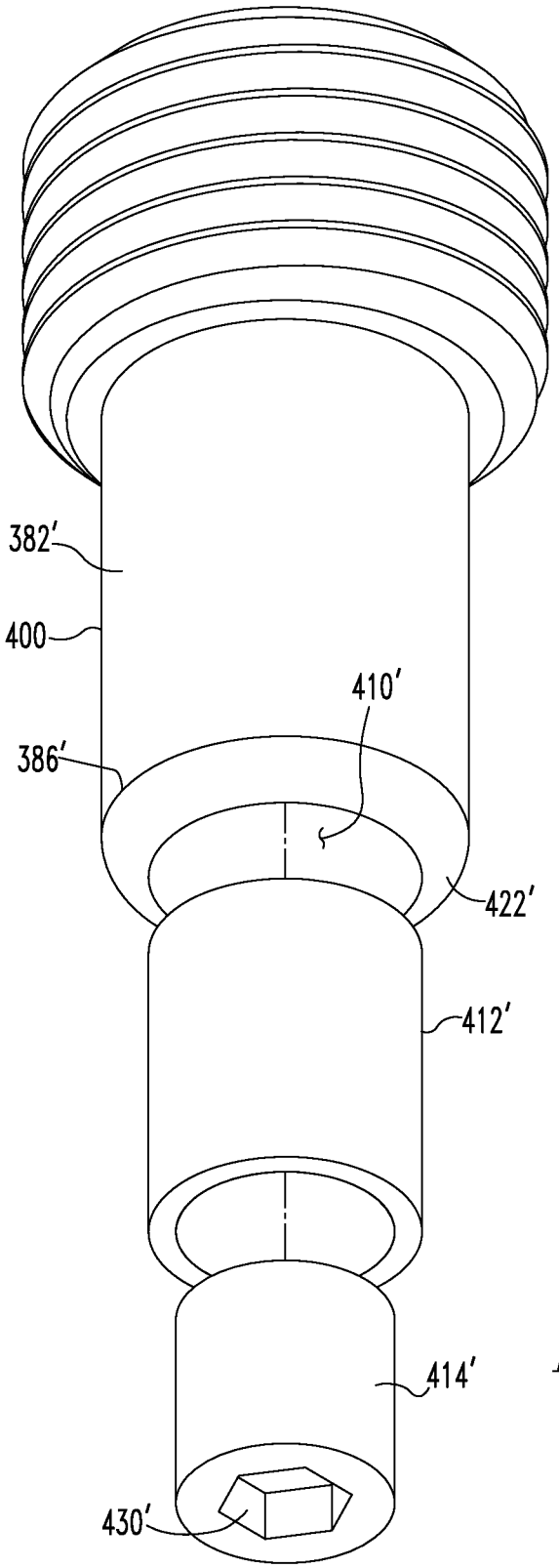
FIG. 7 is a schematic exploded detail isometric view of another alternate embodiment intermediate arc contact assembly.

At least one intermediate first arc contact assembly conductive insert body 382' includes additional arc suppression features. That is, as shown in FIGS. 5-7, in an alternate embodiments, (hereinafter any reference number associated with the first arc contact assembly conductive insert body 382' also include a "prime" mark, i.e. a "'") the intermediate first arc contact assembly conductive insert body second end 386' is an arcing surface 440' and includes a bore 410'. It is further noted that FIGS. 5 and 7 show inserts 382' with different contours/shapes; functionally these inserts 382' are the same. In an exemplary embodiment, the first arc contact assembly conductive insert body second end is a tapered surface 389' that is shaped to correspond to the movable contact assembly support member body passage upper portion 54. That is, in an exemplary embodiment, the taper of the first arc contact assembly conductive insert body second end tapered surface 389' is between 1 degree and 89 degrees, or about 45 degrees relative to a vertical line. In this configuration, the intermediate first arc contact assembly conductive insert body second end 386' is structured to substantially block, or plug, the movable contact assembly support member body passage 50. Further, the first arc contact assembly conductive insert body second end tapered surface 389' is part of an arcing surface 440'. That is, the first arc contact assembly conductive insert body second end tapered surface 389' along with the intermediate first arc contact assembly conductive insert body second end outer surface 422', described below, form the first arc contact assembly conductive insert body second end arcing surface 440'. This alternate embodiment arcing surface may be described alternately as the "intermediate first arc contact assembly conductive insert body arcing surface 440'," or the "intermediate first arc contact assembly arcing surface 440'."

Within the intermediate first arc contact assembly conductive insert body second end bore 410' there is a hollow, tubular outer sleeve 412', made from an arc attracting metal, and an inner lug 414', made from an arc repelling material. The sleeve 412' is disposed in the intermediate first arc contact assembly conductive insert body second end bore 410'. The lug 414' is disposed in the sleeve 412'. In an exemplary embodiment, the intermediate first arc contact assembly conductive insert body second end axial surface 402' includes an outer surface 422', a medial surface 424', and a central surface 426'. The intermediate first arc contact assembly conductive insert body second end outer surface 422', which is the material of the first arc contact assembly conductive insert body 382', extends about the intermediate first arc contact assembly conductive insert body second end medial surface 424'. Similarly, the medial surface 424' extends about the central surface 426'. That is, the outer surface 422' and the medial surface 424' are generally concentric about the central surface 426'. Further, the central surface 426', in an exemplary embodiment, includes a cavity 430' that is structured to accommodate an installation tool, such as, but not limited to, an Allen wrench. Further, the cavity 430' assists the formation of a displaced low pressure zone and/or a vortex, as described below.

Each intermediate arc contact assembly second arc contact assembly 302 includes a conductive insert 450. Hereinafter, the term "intermediate arc contact assembly second arc contact assembly 450" shall be reduced to "intermediate second arc contact assembly 450." Each intermediate second arc contact assembly conductive insert 450 includes a tubular, elongated body 452 with a first end 454, a second end 456, an outer surface 458 an inner surface 460 which defines a passage 461. The intermediate second arc contact assembly conductive insert body outer surface 458 at the second end 456 includes threads 462 that correspond to the intermediate arc contact assembly support member conductive body wide portion inner surface threads 330. The intermediate second arc contact assembly conductive insert body inner surface 460 at the first end 454 is flared. The flared surface is an arcing surface 470, as described below. This arcing surface may be described alternately as the "intermediate second arc contact assembly conductive insert body arcing surface 470," or the "intermediate second arc contact assembly arcing surface 470."

Further, in this configuration, each intermediate first arc contact assembly arcing surface 398 and intermediate second arc contact assembly arcing surface 470 is disposed on a removable component. That is, the intermediate first arc contact assembly conductive insert 380 and the intermediate second arc contact assembly conductive insert 450 are both removably coupled to the intermediate arc contact assembly support member conductive body 310 by a removable coupling assembly. In an exemplary embodiment, the removable coupling assembly is a threaded removable coupling assembly.

As noted above, in an exemplary embodiment, each collapsible chamber 200 includes a positioning assembly 216 structured to move the associated collapsible chamber 200 from at least one configuration to the other configuration. A positioning assembly 216, in an embodiment not shown, includes a rack-and-pinion assembly coupled to each collapsible chamber 200. Such a rack-and-pinion assembly may include a drive assembly (not shown) such as, but not limited to, a servo-motor. Another positioning assembly 216 in an embodiment not shown, includes a pressure control assembly structured to control the pressure in each collapsible chamber 200 so as to control the volume of each collapsible chamber 200. In an exemplary embodiment, as shown, a positioning assembly 216 includes a telescopic limiter assembly 500 and a resilient member 502.

That is, in an exemplary embodiment, telescopic limiter assembly 500 includes a non-conductive sidewall assembly 504 including an outer telescopic member 510 and an inner telescopic member 512 disposed in a telescopic relationship. That is, the outer telescopic member 510 has an inner radius that generally corresponds to the outer radius of the inner telescopic member 512. It is understood that if the telescopic limiter assembly 500 has a shape other than generally cylindrical, the outer telescopic member 510 and inner telescopic member 512 have a corresponding shape wherein the cross-sectional area of the outer telescopic member 510 is slightly larger than the cross-sectional area of the inner telescopic member 512. In this configuration, the inner telescopic member 512 is structured to be, and is, slidably disposed within the outer telescopic member 510.

An outer telescopic member 510 includes a non-conductive, elongated generally cylindrical body 520 having a sidewall 522, an upper end 524, a lower end 526, an inner surface 528 and an outer surface 530. In an exemplary embodiment, an upper, inwardly extending flange 532 is disposed at the outer telescopic member body upper end 524. A bi-directional flange 534, i.e. a flange that extends both inwardly and outwardly, is disposed at the outer telescopic member body lower end 526. The bi-directional flange 534 includes a central opening 536.

The inner telescopic member 512 includes a non-conductive, elongated generally cylindrical body 540 having a sidewall 542, an upper end 544, a lower end 546, an inner surface 548 and an outer surface 550. In an exemplary embodiment, an outwardly extending flange 552 is disposed at the inner telescopic member body upper end 544. Similarly, an outwardly extending flange 554 is disposed at the inner telescopic member body lower end 546.

The outer telescopic member 510 and the inner telescopic member 512 are slidably and telescopically coupled. That is, the inner telescopic member 512 is slidably disposed within the outer telescopic member 510. In this configuration, the telescopic limiter assembly 500 is structured to move between an expanded, first configuration, wherein the outer telescopic member 510 and the inner telescopic member 512 are substantially, longitudinally offset from each other, and a collapsed, second configuration, wherein the inner telescopic member 512 is substantially disposed within the outer telescopic member 510. In the first configuration, the outer telescopic member body upper end inwardly extending flange 532 extends over the inner telescopic member body upper end outwardly extending flange 552. In this configuration, the inner telescopic member 512 is prevented from moving out of the outer telescopic member 510.

The positioning assembly resilient member 502 is, in an exemplary embodiment, a compression spring 560. In an exemplary embodiment, the compression spring 560 is disposed about the outside of the telescopic limiter assembly and engages the inner telescopic member body upper end outwardly extending flange 552 and the outer telescopic member body lower end bi-directional flange 534. That is, these two flanges 552, 534 provide a mounting for the compression spring 560. The compression spring 560 biases the telescopic limiter assembly 500 to the expanded, first configuration. That is, the positioning assembly 216 is structured to move the associated collapsible chamber 200 from at least one configuration to the other configuration and, in the disclosed embodiment, from the second configuration to the first configuration.

A noted above, the collapsible chambers 200 are generally similar and each would generally include the elements identified above. As further noted above, the collapsible chambers 200 are disposed in series and are generally disposed along a common axis. In this configuration, the two end collapsible chambers 200 have, in an exemplary embodiment, a limited number of differences. For example, as noted above, the first collapsible chamber sidewall assembly 214 includes a single fixed sidewall 218A. (Again it is noted that the letter "A" in the reference number indicates that a specific sidewall assembly inner sidewall member is being identified.) Further, the upper first collapsible chamber 200A, which is generally disposed about the fixed arc contact assembly 110, includes a number of radial openings 599 through the first collapsible chamber fixed sidewall 218A (which is also identified as the second collapsible chamber sidewall assembly inner sidewall member 222). These radial openings 599 are hereinafter identified as "first collapsible chamber circumferential fluid control port 600." The first collapsible chamber fluid control port 600 is disposed adjacent the second collapsible chamber sidewall assembly inner sidewall member body upper, first end 252A. The first collapsible chamber circumferential fluid control port 600 is part of the arc extinguishing assembly 26, as discussed below. Further, the first collapsible chamber fixed sidewall 218A includes an upper end with an outwardly extending flange 253A. A number of openings 255A extend through the first collapsible chamber fixed sidewall flange 253A.

Further, the lower most, third collapsible chamber 200C includes an alternate embodiment of the telescopic limiter assembly 500C. Unless stated otherwise, the alternate embodiment of the telescopic limiter assembly 500C includes elements similar to the telescopic limiter assembly 500 discussed above. The telescopic limiter assembly 500C includes an inner telescopic member body 540C having a medial groove 602 extending upwardly from the inner telescopic member body lower end 546C. That is, the medial groove 602 is disposed generally between the inner telescopic member body inner surface 548C and outer surface 550C. The medial groove 602 corresponds to the associated positioning assembly resilient member 502C and acts as a mounting therefore. Further, in an exemplary embodiment, the inner telescopic member body 540C includes an upper surface 604C having a segmented collar 606C. As with the fixed arc contact assembly conductive insert body flange segmented collar 166, the inner telescopic member body segmented collar 606C is, in an exemplary embodiment, a toroidal ridge having gaps therein. The inner telescopic member body segmented collar 606C assists in directing fluid flow. That is, the inner telescopic member body segmented collar 606C is part of the arc extinguishing assembly 26, as discussed below. It is again noted that inner telescopic member body segmented collar 606C is not required and the lack of an inner telescopic member body segmented collar 606C allows the chambers 200C to form without fluid flow paths other than through the intermediate arc contact assembly fluid control ports 360, as described below.

The circuit breaker assembly 10 is assembled as follows (although not necessarily in the following order). The movable contact assembly stem 36 is coupled to the movable contact assembly moving support member 30. In an exemplary embodiment, the stem upper portion threads 59 are coupled to the movable contact assembly support member body passage lower portion threads 57. In this configuration, the movable contact assembly support member body passage 50 is in fluid communication with the stem body upper portion axial bore 76. Further, movable contact assembly stem 36 is in electrical communication with the movable contact assembly moving support member 30.

The movable main contact assembly body 100 is coupled to the movable contact assembly support member upper side 41. That is, movable main contact assembly threaded fasteners 102 are passed through movable main contact assembly body openings 101 and into the movable contact assembly support member body upper side threaded bores 45. Further, the alternate embodiment of the telescopic limiter assembly 500C is coupled to the movable main contact assembly body 100 by the movable main contact assembly threaded fasteners 102. That is, the movable main contact assembly threaded fasteners 102 extend through openings 612 in the telescopic limiter assembly body bi-directional flange 534, thereby coupling, directly coupling, or fixing the telescopic limiter assembly 500C to the movable main contact assembly body 100. The telescopic limiter assembly 500C is disposed about the movable contact assembly arc contact assembly 32, i.e. movable contact assembly support member body passage 50. In this configuration the movable contact assembly moving support member 30 is in electrical communication with the movable main contact assembly body 100. Further, the movable main contact assembly threaded fasteners 102 couple the third collapsible chamber positioning assembly 216C to the movable main contact assembly body 100. That is, the telescopic limiter assembly outer telescopic member 510C is directly coupled to the movable main contact assembly body 100.

As noted above, each intermediate arc contact assembly 114 is part of two adjacent collapsible chambers 200. For the following description, each intermediate arc contact assembly 114 shall be described in association with the upper of the two adjacent collapsible chambers 200 with which it is associated. Thus, for example, the intermediate arc contact assembly support member conductive body 310 that forms the lower, second end wall 212 of the second collapsible chamber 200B will be identified as second collapsible chamber intermediate arc contact assembly support member conductive body 310B. It is understood, however, that the specific intermediate arc contact assembly support member conductive body 310 is also the upper, first end wall 210 of third collapsible chamber 200C. Further, with this naming convention, the fixed arc contact assembly 110 is disposed in the first collapsible chamber 200A, the first collapsible chamber first arc contact assembly 300A (which is removably coupled to the first collapsible chamber intermediate arc contact assembly support member 304A) is disposed in the second collapsible chamber 200B, and the second collapsible chamber first arc contact assembly 300B (which is removably coupled to the second collapsible chamber support member 304B) is disposed in the third collapsible chamber 200C (when the movable contact assembly 20 is in the second position).

The second collapsible chamber 200B is partially assembled with the second collapsible chamber positioning assembly 216B coupled to the second collapsible chamber intermediate arc contact assembly support member conductive body wide portion upper surface 320B. That is, the second collapsible chamber intermediate second arc contact assembly conductive insert 450B is passed through the second collapsible chamber positioning assembly 216B and the second collapsible chamber intermediate second arc contact assembly conductive insert body outer surface second end threads 462B are removably coupled to the second collapsible chamber intermediate arc contact assembly support member conductive body wide portion inner surface threads 330B, Further, the second collapsible chamber intermediate second arc contact assembly conductive insert body first end 454B has a greater radius than the second collapsible chamber outer telescopic member bi-directional flange opening 536B. In this configuration, the second collapsible chamber intermediate second arc contact assembly conductive insert 450B couples the second collapsible chamber positioning assembly 216B to the second collapsible chamber intermediate arc contact assembly support member conductive body wide portion upper surface 320B.

Further, in an exemplary embodiment, the alternate embodiment of the intermediate first arc contact assembly conductive insert body 382' is removably coupled to the second collapsible chamber intermediate arc contact assembly support member conductive body narrow portion 314B. That is, a second collapsible chamber alternate embodiment of the intermediate first arc contact assembly conductive insert body first end threads 388B are removably coupled to the second collapsible chamber intermediate arc contact assembly support member conductive body narrow portion second end threads 352B. In this configuration, the second collapsible chamber intermediate first arc contact assembly conductive insert body 382B' plugs the second collapsible chamber intermediate arc contact assembly support member conductive body narrow portion passage 340B.

The second collapsible chamber intermediate arc contact assembly support member conductive body 310B is slidably disposed within the second collapsible chamber sidewall assembly outer sidewall member 220B. In this configuration, second collapsible chamber intermediate arc contact assembly support member conductive body 310B, or the associated sealing members 328, sealingly engage the second collapsible chamber sidewall assembly outer sidewall member 220B. In this configuration, movement of the first end wall 210B and/or the second end wall 212B relative to the sidewall assembly 214B reduces the volume of the second collapsible chamber 200B.

The first collapsible chamber 200A is assembled with the first collapsible chamber positioning assembly 216A coupled to the first collapsible chamber intermediate arc contact assembly support member conductive body wide portion upper surface 320A. That is, the first collapsible chamber intermediate second arc contact assembly conductive insert 450A is passed through the first collapsible chamber positioning assembly 216A and the first collapsible chamber intermediate second arc contact assembly conductive insert body outer surface second end threads 462A are removably coupled to the first collapsible chamber intermediate arc contact assembly support member conductive body wide portion inner surface threads 330A. Further, the first collapsible chamber intermediate second arc contact assembly conductive insert body first end 454A has a greater radius than the first collapsible chamber outer telescopic member bi-directional flange opening 536A. In this configuration, the first collapsible chamber intermediate second arc contact assembly conductive insert 450A couples the first collapsible chamber positioning assembly 216A to the first collapsible chamber intermediate arc contact assembly support member conductive body wide portion upper surface 320A.

Further, in an exemplary embodiment, the first embodiment of the intermediate first arc contact assembly conductive insert body 382 is removably coupled to the first collapsible chamber intermediate arc contact assembly support member conductive body narrow portion 314A. That is, a first collapsible chamber intermediate first arc contact assembly conductive insert body first end threads 388A are removably coupled to the first collapsible chamber intermediate arc contact assembly support member conductive body narrow portion second end threads 352A. In this configuration, the first collapsible chamber intermediate first arc contact assembly conductive insert body 382A plugs the first collapsible chamber intermediate arc contact assembly support member conductive body narrow portion passage 340A.

The first collapsible chamber intermediate arc contact assembly support member conductive body 310A is slidably disposed within the first collapsible chamber sidewall assembly fixed sidewall 218A. In this configuration, first collapsible chamber intermediate arc contact assembly support member conductive body 310A, or the associated sealing members 328, sealingly engage the first collapsible chamber fixed sidewall 218A. Further, in this configuration, movement of the first end wall 210A reduces the volume of the first collapsible chamber 200A.

The fixed main contact assembly 112 is coupled, directly coupled, or fixed to the housing assembly 12. That is, in an exemplary embodiment, the fixed main contact assembly 112 is disposed against the housing assembly upper wall 11 with fixed main contact assembly body base portion central opening 177 aligned with the housing assembly upper wall upper opening 15. The fixed arc contact assembly base member body 124 is passed through the fixed main contact assembly body base portion central opening 177 and the housing assembly upper wall upper opening 15. The fixed arc contact assembly base member body first end 126 is disposed outside the housing assembly enclosed space 18 and is removably coupled to, and in electrical communication with, a line or a load 2, 3 (shown schematically). Further, the fixed arc contact assembly conductive insert body flange upper surface 162 is coupled or directly coupled to the fixed main contact assembly 112 thereby trapping the fixed main contact assembly 112 between the fixed arc contact assembly conductive insert body flange upper surface 162 and the housing assembly upper wall 11. Further, the fixed arc contact assembly conductive insert 122 is removably coupled to the fixed arc contact assembly base member body second end threaded bore 132.

The first collapsible chamber sidewall assembly fixed sidewall member 218 is coupled or directly coupled to the fixed main contact assembly 112. That is, the first collapsible chamber 200A is disposed about the fixed arc contact assembly 110 and within the "bowl" of the fixed main contact assembly body 170. Fasteners 172 are passed through first collapsible chamber sidewall assembly inner sidewall member first end flange openings 255A and threaded into fixed main contact assembly body base portion threaded openings 179. As noted above, in this configuration, the fixed arc contact assembly 110 is disposed in the first collapsible chamber 200A. Further, the first collapsible chamber intermediate second arc contact assembly 302A is disposed in the first collapsible chamber 200A.

The second collapsible chamber 200B is further assembled when the second collapsible chamber sidewall assembly outer sidewall member 220B is telescopically and slidably coupled to the second collapsible chamber inner sidewall member 222B (which is also the first collapsible chamber fixed sidewall 218A). In this configuration, the second collapsible chamber outer sidewall member body upper flange inner surface 240B, or any sealing members 246 disposed thereat, are slidably and sealingly coupled to the outer surface of the second collapsible chamber inner sidewall member 222B. Further, the second collapsible chamber inner sidewall member lower, outwardly extending flange radial outer surface 260 is slidably and sealingly coupled to the outer surface of the second collapsible chamber sidewall assembly outer sidewall member 220B. In this configuration, the first collapsible chamber first arc contact assembly 300A (which is removably coupled to the first collapsible chamber intermediate arc contact assembly support member 304A) is disposed in the second collapsible chamber 200B. Further, the second collapsible chamber intermediate second arc contact assembly 302B is disposed in the second collapsible chamber 200B.

The movable contact assembly support member 30 is disposed in the housing assembly enclosed space 18 with the movable contact assembly support member upper side 41 facing the fixed contact assembly 22. The movable contact assembly support member body radial surface sealing members 46 sealingly and slidably engage the housing assembly cylindrical sidewall 7. In this configuration, the movable contact assembly support member 30 divides the housing assembly enclosed space 18 into an upper housing assembly enclosed space 18' and a lower housing assembly enclosed space 18". Further, as noted above, the operating mechanism 16 is structured to move the movable contact assembly 20 between an open, first position, wherein the movable contact assembly 20 is effectively spaced from the fixed contact assembly 22, and a closed, second position, wherein the movable contact assembly 20 is coupled to, and in electrical communication with, the fixed contact assembly 22. As the movable contact assembly 20 moves from the first position to the second position, the upper housing assembly enclosed space 18' collapses (the volume is reduced) and the lower housing assembly enclosed space 18" expands (the volume is increased). This motion compresses the fluid (gas) in the upper housing assembly enclosed space 18' thereby increasing the pressure in the upper housing assembly enclosed space 18'. When the movable contact assembly 20 moves from the second position to the first position, this process is reversed with the upper housing assembly enclosed space 18' expanding and the lower housing assembly enclosed space 18" collapsing (and increasing the internal fluid pressure).

Due to the configuration of the various elements and the various seals 46, 130, 246, 328 discussed above, there is a single path for the fluid to move from the upper housing assembly enclosed space 18' to the lower housing assembly enclosed space 18". This path, and the manner in which the fluid moves over the path, are part of the arc extinguishing assembly 26. Generally, the arc extinguishing assembly 26 is structured to generate a displaced low pressure zone adjacent at least one arcing surface 64, 150, 398, 440, 470. More specifically, the arc extinguishing assembly 26 includes a fluid flow assembly 700 that is structured to generate a displaced low pressure zone adjacent at least one of the fixed arc contact assembly 110, an intermediate arc contact assembly first arc contact assembly 300, an intermediate arc contact assembly second arc contact assembly 302, or the movable contact assembly arc contact assembly 32.

The fluid flow assembly 700, in an exemplary embodiment, includes the stem body fluid control port 90, the intermediate arc contact assembly fluid control port 360, and the first collapsible chamber circumferential fluid control port 600, along with the generally cylindrical shape of the collapsible chambers 200A, 200B, 200C. That is, the fluid flow assembly 700 elements are structured to create a vortex to generate a displaced low pressure zone. Such a vortex is generated regardless of whether the movable contact assembly 20 is moving into the first or second position. Generally, fluid passing through the various fluid control ports 90, 360, 600 flows in a circular, or helical, pattern due to the radial pattern of the fluid control ports 90, 360, 600. In this exemplary embodiment, each fluid control ports 90, 360, 600 is a vortex inducing port. That is, each fluid control ports 90, 360, 600 is structured to induce or generate a vortex in the collapsible chambers 200A, 200B, 200C.

Figure 8:
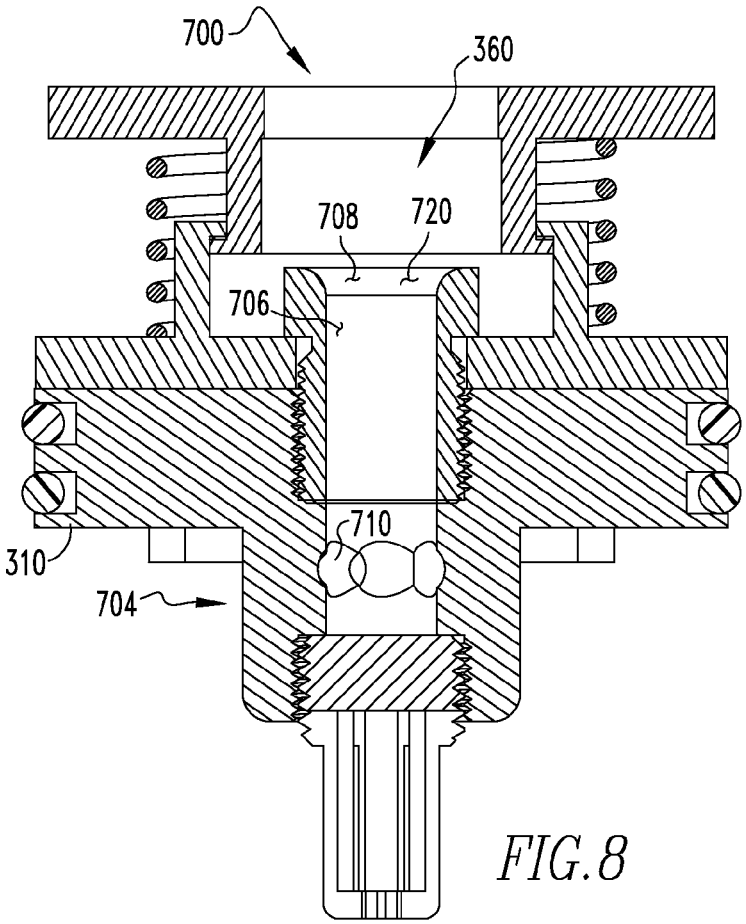
FIG. 8 is a schematic cross-sectional view of a fluid control port and port.
Figure 8A:
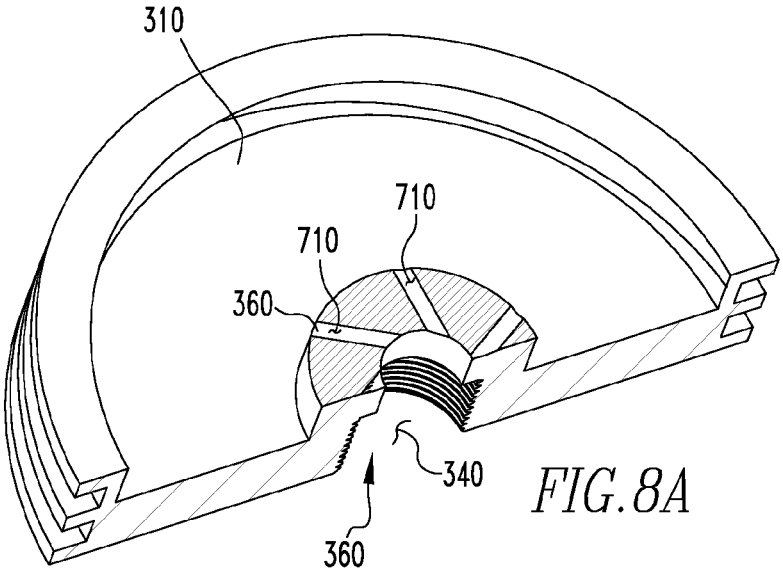
FIG. 8A is an isometric cross-sectional view of a fluid control port.

In an exemplary embodiment, each of the stem body fluid control port 90 and the intermediate arc contact assembly fluid control port 360 include similar elements. FIGS. 8 and 8A uses an intermediate arc contact assembly and fluid control port 360 as an example, but it is understood that fluid control port 90 includes similar elements. As shown in FIG. 7, fluid control port 360 includes a first end 704, a medial portion 706, and a second end 708. Each fluid control port first end 704 includes a number of spiral passages 710. That is, as used herein and as shown in FIG. 8A, a "spiral passage" is a passage from a central passage, such as, but not limited to intermediate arc contact assembly support member conductive body narrow portion passage 340, to a chamber enclosed space 200 or the housing assembly enclosed space 18. Further, as used herein, a "spiral passage" is a passage that does not extend directly radially. That is, as used herein, a "radial passage" is generally straight and has a longitudinal axis that extends generally normal to a radial surface. Conversely, a "spiral passage" has a longitudinal axis that does not extend generally normal to a radial surface. A "spiral passage" may be generally straight, as shown in FIG. 8A, or may be curved (not shown).

Each fluid control port medial portion 706 is an axial passage (these have been previously identified as set forth below). Each spiral passage 710 is in direct fluid communication with a fluid control port medial portion 706. For example, the stem body fluid control port 90 is in direct fluid communication with the stem body upper portion axial bore 76 and each intermediate arc contact assembly fluid control port 360 is in direct fluid communication with an intermediate arc contact assembly axial passage 341. Each fluid control port second end 708 is the end of the axial passage opposite the spiral passages 710 and defines a port 720, i.e. not a fluid control port. Each fluid control port second end 708 is in direct fluid communication with a port 720A, 720B, and 720C, as discussed below.

In an exemplary embodiment, the spiral passages 710 are generally disposed in a plane that is generally perpendicular to the longitudinal axis of either the stem body upper portion axial bore 76 or intermediate arc contact assembly axial passage 341. In this configuration, fluid passing through the spiral passages 710 enters one of the stem body upper portion axial bore 76 or intermediate arc contact assembly axial passage 341, or, enters one of the generally cylindrical collapsible chambers 200A, 200B, 200C (depending upon whether the movable contact assembly 20 is moving into the first or second position), and flows in a generally circular pattern within either the stem body upper portion axial bore 76 or intermediate arc contact assembly axial passage 341. As the fluid moves axially along the stem body upper portion axial bore 76 or intermediate arc contact assembly axial passage 341, or, through the collapsible chambers 200A, 200B, 200C, the fluid flows in a helical pattern, creating a vortex. The vortex creates a low pressure zone at and adjacent the longitudinal axis of the vortex. When the elements of the arc extinguishing contact assembly 24 are arranged as described above, the longitudinal axis of the vortex is disposed, generally adjacent an arcing surface 64, 150, 398, 440, 470 and draws any arc toward the center of the collapsible chambers 200A, 200B, 200C. It is noted that each fluid control port 90, 360, 600 is spaced from any of the arcing surfaces 64,150, 398, 440, 470. Thus, the low pressure zone generated by the fluid control ports 90, 360, 600 is displaced from the fluid control ports 90, 360, 600. That is, in this configuration, the fluid flow assembly 700 is structured to generate a displaced low pressure zone adjacent at least one of the fixed arc contact assembly 110, an intermediate first arc contact assembly 114, an intermediate arc contact assembly second arc contact assembly 302, or the movable contact assembly arc contact assembly 32.

In this configuration, each collapsible chamber 200A, 200B, 200C is associated with at least one fluid control port 90, 360, 600, or, in an exemplary embodiment, with at least two fluid control ports 90, 360, 600. That is, in the disclosed configuration, the first collapsible chamber 200A is associated with the first collapsible chamber circumferential fluid control port 600 and the first collapsible chamber intermediate arc contact assembly fluid control port 360A in that these two fluid control ports 360A, 600 each help create a vortex in the first collapsible chamber 200A. The second collapsible chamber 200B is associated with first collapsible chamber intermediate arc contact assembly fluid control port 360A and the second collapsible chamber intermediate arc contact assembly fluid control port 360B in that these two fluid control ports 360A, 360B each help create a vortex in the second collapsible chamber 200B. The third collapsible chamber 200C is associated with the second collapsible chamber intermediate arc contact assembly fluid control port 360B and the stem body fluid control port 90 in that these two fluid control ports 360B, 90 each help create a vortex in the third collapsible chamber 200C.

At the end of each fluid control port 90, 360, 600 is a port 720A, 720B, and 720C. Each port 720A, 720B, and 720C is associated with one of the collapsible chambers 200A, 200B, 200C. The first collapsible chamber port 720A is disposed at the top of the first collapsible chamber intermediate arc contact assembly axial passage 341A. The second collapsible chamber port 720B is disposed at the top of the second chamber intermediate arc contact assembly axial passage 341B. The third collapsible chamber port 720C is disposed at the top of the stem body upper portion axial bore 76. It is noted that the ports 720A, 720B, 720C are not "fluid control ports." That is, for example, if instead of the fluid control port 90, 360, 600 described above, each collapsible chamber 200A, 200B, 200C included an opening aligned with the ports 720A, 720B, 720C, the resulting fluid flow would not be a directed fluid flow, i.e. a fluid flow with an intended flow pattern.

As noted above, the movable contact assembly 20 moves between an open, first position, wherein any of the arcing surfaces 64,150, 398, 440, 470 are effectively spaced from an associated any of the arcing surfaces 64,150, 398, 440, 470, and a closed, second position, wherein the movable contact assembly 20 is coupled to, and in electrical communication with, the fixed contact assembly 22. More specifically, in the second position both the movable contact assembly arc contact assembly 32 and the movable contact assembly main contact assembly 34 are coupled to, and in electrical communication with, the fixed arc contact assembly 110 and the fixed main contact assembly 112, respectively. Further, during the movable contact assembly's 20 transition between the first and second positions, the movable contact assembly 20 also moves into an "arcing position" wherein an arc forms between the various arcing surfaces 64, 150, 398, 440, 470 as well as an initial closed position, wherein the movable contact assembly arc contact assembly 32 and the fixed arc contact assembly 110, are coupled, and in electrical communication, but before the movable contact assembly main contact assembly 34 and the fixed main contact assembly 112 are coupled and in electrical communication. Further, and as discussed below, during the separation of the movable contact assembly 20 from the fixed contact assembly 22, the fixed contact assembly 22 acts as a "relief valve" and is disposed in a relief valve configuration.

In general, arc extinguishing contact assembly 24 and the fluid flow assembly 700 operate as follows. When the movable contact assembly 20 is moving into the second position, i.e. the contacts 20, 22 are closing, the lower housing assembly enclosed space 18" is expanding and the upper housing assembly enclosed space 18' is collapsing. Thus, the pressure in the upper housing assembly enclosed space 18' is increasing and the pressure in the lower housing assembly enclosed space 18" is decreasing. In this configuration, fluid moves from the upper housing assembly enclosed space 18' to the lower housing assembly enclosed space 18".

When the movable contact assembly 20 is far from the fixed contact assembly 22, for example, prior to the formation of the third collapsible chamber 200C, as discussed below, fluid flows generally from the upper housing assembly enclosed space 18' through the third port 720C, i.e. the stem body upper portion axial bore 76. At this point there is little, or negligible fluid flow in the first and second collapsible chambers 200A, 200B.

As the movable contact assembly 20 approaches the fixed contact assembly 22, the third collapsible chamber inner telescopic member body segmented collar 606C engages the second collapsible chamber intermediate arc contact assembly support member conductive body wide portion lower surface 322, thereby forming the third collapsible chamber 200C. It is noted that at this point, force from the movable contact assembly 20 is now transferred through various elements to the fixed contact assembly 22 and the collapsible chambers 200A, 200B, 200C start to collapse.

In this configuration, the fluid flow through the upper housing assembly enclosed space 18' changes. That is, to reach the third port 720C, fluid now flows from the upper housing assembly enclosed space 18' through the first collapsible chamber fluid control port(s) 600 and into the first collapsible chamber 200A. This fluid passes through the fixed arc contact assembly conductive insert body flange segmented collar 166 into the first collapsible chamber positioning assembly 216A. Similarly, as the first collapsible chamber 200A collapses, fluid within the first collapsible chamber 200A passes through the fixed arc contact assembly conductive insert body flange segmented collar 166 into the first collapsible chamber positioning assembly 216A. Within the first collapsible chamber 200A, fluid flows through the first collapsible chamber port 720A, through the first collapsible chamber intermediate arc contact assembly axial passage 341A and out through the first collapsible chamber intermediate arc contact assembly fluid control port 360A (which, as noted above, are in the second collapsible chamber 200B.) As described above, this fluid flow generates a vortex within the first collapsible chamber 200A.

It is noted that the collapse of the first collapsible chamber 200A is accomplished by the motion of the first collapsible chamber second end wall 212A moving toward the first collapsible chamber first end wall 210A. That is, in the disclosed configuration, and in an exemplary embodiment, the first collapsible chamber first end wall 210A is the fixed main contact assembly body 170 (or fixed arc contact assembly conductive insert body flange 160 which is directly coupled to the fixed main contact assembly body 170). Further, the first collapsible chamber second end wall 212A is the first collapsible chamber intermediate arc contact assembly support member conductive body 310A which, as noted above, is slidably disposed within the first collapsible chamber sidewall assembly fixed sidewall 218A.

After the fluid exits the first collapsible chamber 200A, the fluid enters the second collapsible chamber 200B via the first collapsible chamber intermediate arc contact assembly fluid control port(s) 360A, and passes into the second collapsible chamber positioning assembly 216B. Further, if a the first collapsible chamber (200A) includes a segmented collar 370, as the second collapsible chamber 200B collapses, fluid within the second collapsible chamber 200B passes through the first collapsible chamber intermediate arc contact assembly support member conductive body wide portion lower surface segmented collar 370A (which is disposed in the second chamber 200B) and into the second collapsible chamber positioning assembly 216B. The fluid then flows through the second collapsible chamber port 720B, through the second collapsible chamber intermediate arc contact assembly axial passage 341B and out through the second collapsible chamber intermediate arc contact assembly fluid control port(s) 360B (which, as noted above, are in the third collapsible chamber 200C.) As described above, this fluid flow generates a vortex within the second collapsible chamber 200B.

It is noted that the collapse of the second collapsible chamber 200B is accomplished by both movable second collapsible chamber first end wall 210B and a movable second collapsible chamber second end wall 212B, as well as the telescoping sidewalls. That is, the second collapsible chamber first end wall 210B is the first collapsible chamber intermediate arc contact assembly support member conductive body 310A. This element moves within the first collapsible chamber 200A, as described above. This motion, however, also changes the volume of the second collapsible chamber 200B. Further, the second collapsible chamber second end wall 212B is the second collapsible chamber intermediate arc contact assembly support member conductive body 310B. This element is slidably disposed in the second collapsible chamber sidewall assembly 214B. As the second collapsible chamber intermediate arc contact assembly support member conductive body 310B moves relative to the second collapsible chamber sidewall assembly 214B, the volume of the second collapsible chamber 200B changes. Further, the second collapsible chamber sidewall assembly 214B includes telescopically coupled second collapsible chamber outer sidewall member 220B and second collapsible chamber inner sidewall member 222B. As the second collapsible chamber sidewall assembly 214B moves telescopically, the volume of the second collapsible chamber 200B changes. The movement of the movable second collapsible chamber first end wall 210B, movable second collapsible chamber second end wall 212B, and the second collapsible chamber sidewall assembly 214B occur simultaneously.

After the fluid exits the second collapsible chamber 200B, fluid enters the third collapsible chamber 200C via the second collapsible chamber intermediate arc contact assembly fluid control port(s) 360B, and passes into the third collapsible chamber positioning assembly 216C. Further, if a the third collapsible chamber 200C includes a segmented collar 606C, as the third collapsible chamber 200C collapses, fluid within the third collapsible chamber 200C passes through the third collapsible chamber inner telescopic member body segmented collar 606C and into the third collapsible chamber positioning assembly 216C. The fluid then flows through the third collapsible chamber port 720C, through stem body upper portion axial bore 76 and out through the stem body fluid control port 90 (which, as noted above, are in the lower housing assembly enclosed space 18".) As described above, this fluid flow generates a vortex within the third collapsible chamber 200C.

It is noted that the collapse of the third collapsible chamber 200C is accomplished by both movable second collapsible chamber first end wall 210B and as well as the telescoping sidewalls of the second chamber 200B. That is, the third collapsible chamber first end wall 210C is the second collapsible chamber intermediate arc contact assembly support member conductive body 310B. The third collapsible chamber second end wall 212C is the movable main contact assembly 34. As noted above, second collapsible chamber intermediate arc contact assembly support member conductive body 310B is both slidably disposed in the second collapsible chamber sidewall assembly 214B and moves along with the telescopic motion of the second collapsible chamber sidewall assembly 214B.

The vortex fluid flow pattern in each collapsible chamber 200A, 200B, 200C remains until the movable contact assembly arc contact assembly 32, the fixed contact assembly 112, and any intermediate arc contact assemblies 114 are closed, as described below. Further, it is noted that the movement of the movable contact assembly 20 and the movement of the collapsible chambers 200A, 200B, 200C between configurations generates the fluid flow through the collapsible chambers 200A, 200B, 200C. In an exemplary embodiment, the movement of the movable contact assembly 20 and the movement of the collapsible chambers 200A, 200B, 200C between configurations is the exclusive method of generating fluid flow within the collapsible chambers 200A, 200B, 200C.

As the movable contact assembly 20 continues to approach the fixed contact assembly 22, the various arcing surfaces 64, 150, 398, 440, 470 will move into an arcing position and generate a local arc. In an exemplary embodiment, the arcing surfaces 64, 150, 398, 440, 470 move into an arcing position substantially at the same time, i.e. substantially simultaneously. That is, as noted above, the positioning assembly 216 is structured to move associated collapsible chamber 200 from at least one configuration to the other configuration at a synchronized rate. A "synchronized rate," as used herein, means that the positioning assembly 216 is structured to move so as to place the various arcing surfaces 64, 150, 398, 440, 470, into an "arcing position" at substantially the same time, and, into contact at substantially the same time. In an exemplary embodiment, the rate of the collapse of each positioning assembly 216A, 216B, 216C is controlled by the strength of the resilient member 502A, 502B, 502C. That is, the first collapsible chamber 200A moves the first collapsible chamber intermediate second arc contact assembly conductive insert body first end 454A into an arcing position relative to the fixed arc contact assembly conductive insert body second end 146. In this configuration, an arc forms between the fixed arc contact assembly conductive insert body second end arcing surface 150 and the first collapsible chamber intermediate second arc contact assembly conductive insert arcing surface 470A.

Similarly, the second collapsible chamber 200B moves the second collapsible chamber intermediate second arc contact assembly conductive insert body first end 454B into an arcing position relative to the first collapsible chamber intermediate first arc contact assembly conductive insert body second end 600. In this configuration, an arc forms between the first collapsible chamber intermediate first arc contact assembly conductive insert arcing surface 398 and the second collapsible chamber intermediate second arc contact assembly conductive insert arcing surface 470B.

Similarly, the third collapsible chamber 200C moves the movable contact assembly support member body passage upper portion 54 into an arcing position relative to the second collapsible chamber intermediate first arc contact assembly conductive insert body second end 386B. As noted above, in an exemplary embodiment, the first arc contact assembly conductive insert body 382' is used in the third collapsible chamber 200C. Thus, in this configuration, an arc forms between the second collapsible chamber intermediate first arc contact assembly conductive insert body second end arcing surface 440 and the movable contact assembly support member body passage upper portion arcing surface 64. Thus, each intermediate arc contact assembly 114 generates at least one local arc. Further, each local arc is generated from at least one of an intermediate first arc contact assembly arcing surface 398 or an intermediate second arc contact assembly arcing surface 470.

Figure 10B:
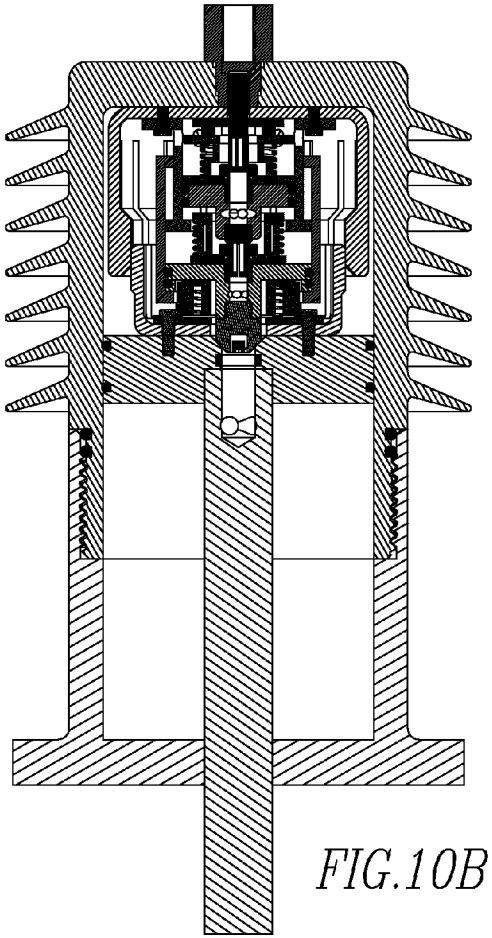
FIGS. 10A-10G are schematic cross-sectional side views of a circuit breaker with an alternate positioning assembly structured to open the arc contact assemblies at different times.
Figure 10A:
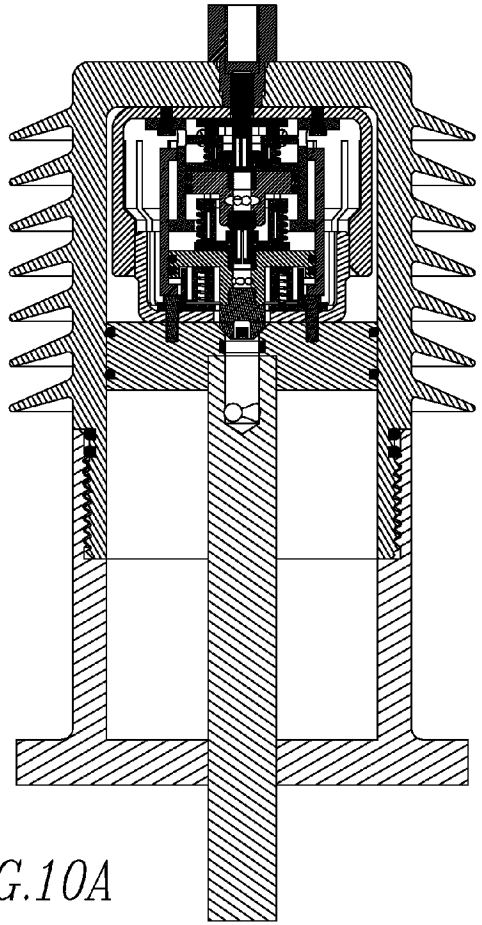
Figure 10D:
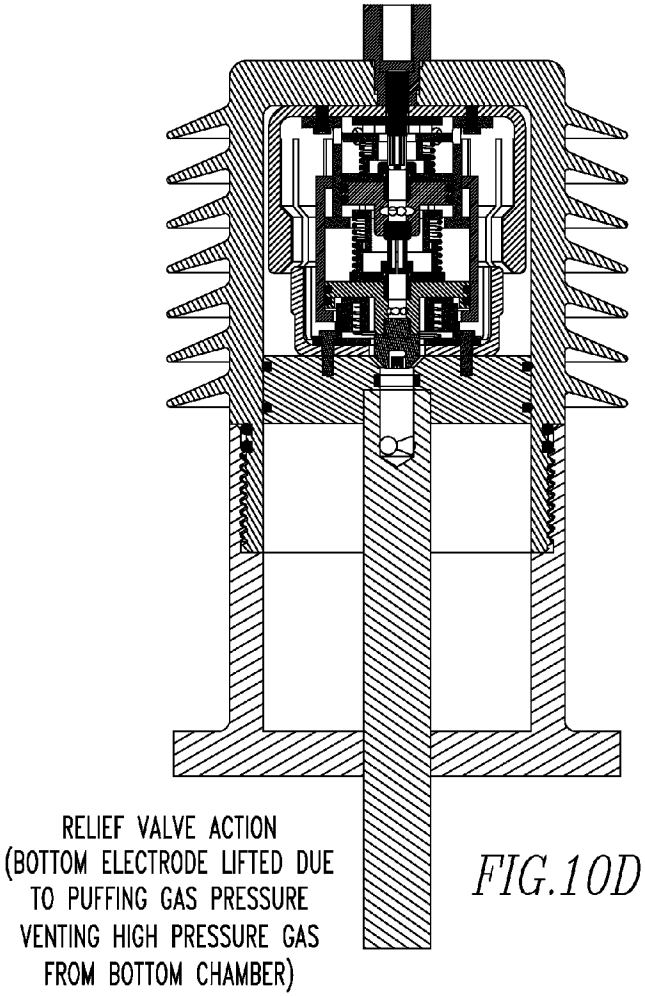
Figure 10C:
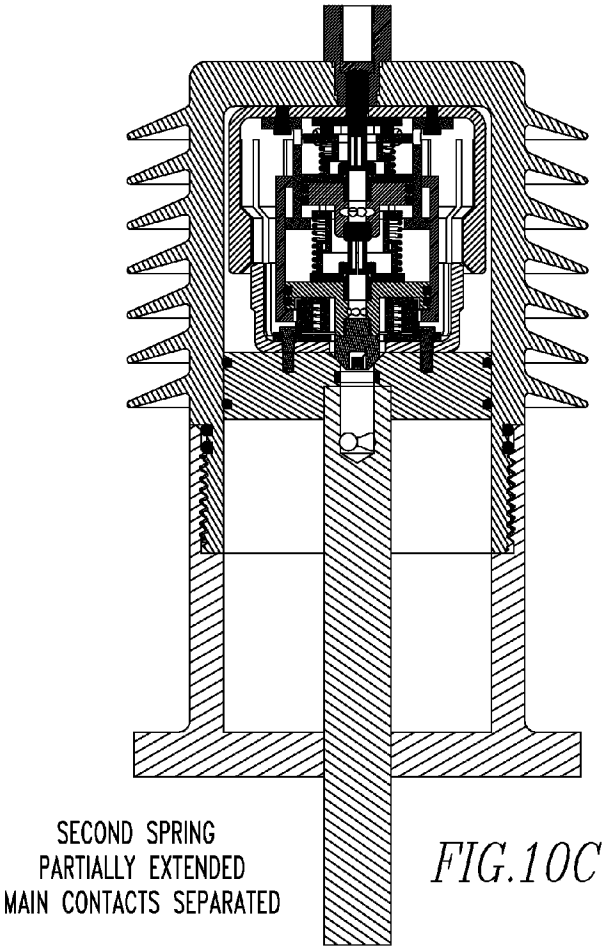
Figure 10F:
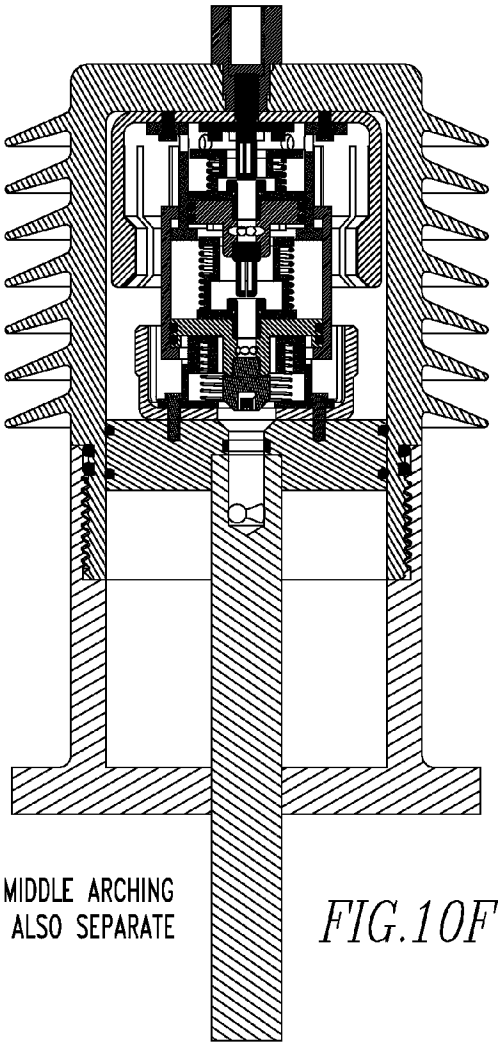
Figure 10E:
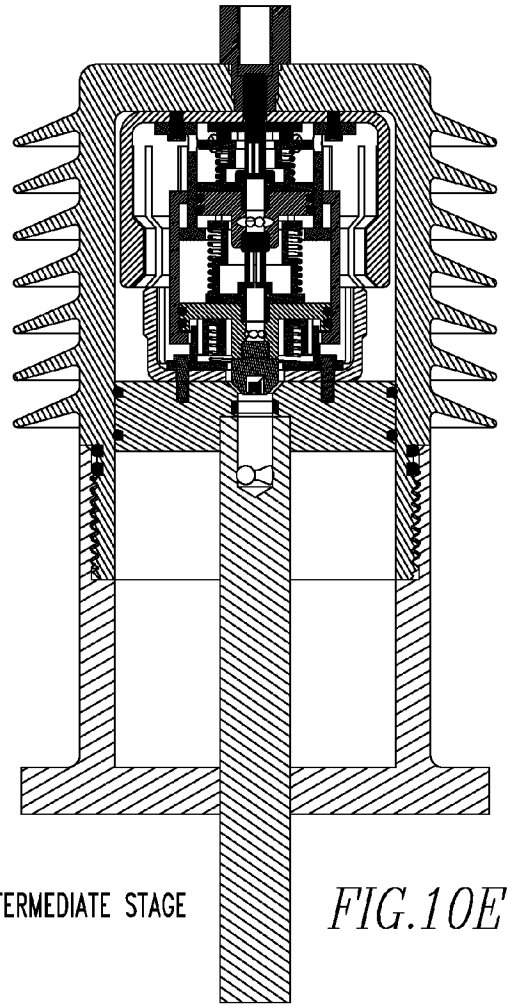
Figure 10G:
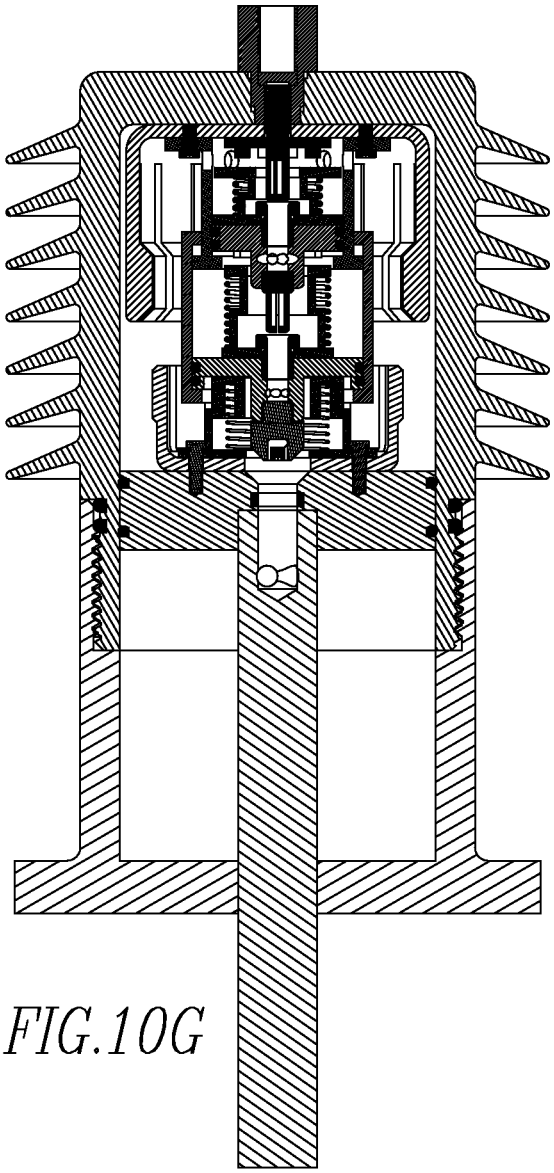

As noted above, the various motions described in the above paragraphs occur substantially simultaneously due to the positioning assembly 216 moving the collapsible chambers 200A, 200B, 200C, or allowing the collapsible chambers 200A, 200B, 200C to move, from one configuration to the other configuration, at a synchronized rate. In a number of alternate embodiments, the positioning assembly(ies) 216 are structured to move the various arcing surfaces 64, 150, 398, 440, 470 into an arcing position at different times. As before, the positioning of the various arcing surfaces 64, 150, 398, 440, 470 is controlled by the positioning assembly 216 or positioning assemblies 216A, 216B, 216C, . . . 216N. In such alternate embodiments, selected arcing surfaces are moved into an arcing position at a selected time, e.g. before or after, relative to other arcing surfaces. An example of an alternate opening sequence, wherein the various arcing surfaces 64, 150, 398, 440, 470 are in an arcing position at different times, is shown in FIGS. 10-10F.

Further, as set forth above, the fluid flow assembly 700 is generating a vortex in each collapsible chambers 200A, 200B, 200C as each arc forms. The center of the vortex is disposed, generally adjacent the arcing surface 64, 150, 398, 440, 470 and draws any arc toward the center of the collapsible chambers 200A, 200B, 200C. In this configuration, the arc is extinguished and is substantially prevented from moving from the various removable inserts 122, 380, 450 described above. That is, the removable inserts 122, 380, 450 include a removable coupling assembly and, in an exemplary embodiment, a threaded removable coupling assembly.

As the movable contact assembly 20 continues to approach the fixed contact assembly 22, the arcing surfaces 64, 150, 398, 440, 470 move into engagement with each other and are disposed in electrical communication. That is, the fixed arc contact assembly conductive insert body second end arcing surface 150 and the first collapsible chamber intermediate second arc contact assembly conductive insert arcing surface 470A are coupled and are in electrical communication. Stated more broadly, the fixed arc contact assembly 110 is coupled to, and in electrical communication with the first collapsible chamber intermediate arc contact assembly support member conductive body 310A. Further, the first collapsible chamber intermediate first arc contact assembly conductive insert arcing surface 398 and the second collapsible chamber intermediate second arc contact assembly conductive insert arcing surface 470B are coupled and are in electrical communication. Stated more broadly, the first collapsible chamber intermediate arc contact assembly support member conductive body 310A and the second collapsible chamber intermediate arc contact assembly support member conductive body 310B are coupled and are in electrical communication. Further, the second collapsible chamber intermediate first arc contact assembly conductive insert body second end arcing surface 440' and the movable contact assembly support member body passage upper portion arcing surface 64 are coupled and are in electrical communication. Stated more broadly, the second collapsible chamber intermediate arc contact assembly support member conductive body 310B and the movable contact assembly arc contact assembly 32 are coupled and are in electrical communication. The movement of the various elements are still controlled by the positioning assemblies 216A, 216B, 216C at a synchronized rate. That is, the elements identified in this paragraph move into contact, i.e. become coupled and in electrical communication, at substantially the same time. Thus, the movable contact assembly arc contact assembly 32 and the fixed arc contact assembly 110 are coupled and in electrical communication.

It is further noted that, in an exemplary embodiment, the intermediate first arc contact assembly conductive insert body second end 386' is shaped to correspond to the movable contact assembly support member body passage upper portion 54. Thus, when the first arc contact assembly conductive insert body 382' moves into engagement with the movable contact assembly support member body 40, the first arc contact assembly conductive insert body 382' substantially blocks the movable contact assembly support member body passage 50 and substantially reduces the fluid flow therethrough. That is, the fluid flow through the movable contact assembly support member body passage 50 is effectively reduced to no fluid flow.

As the movable contact assembly 20 continues to approach the fixed contact assembly 22, the movable main contact assembly 34 and the fixed main contact assembly 112 move into engagement with each other and become coupled and in electrical communication. It is noted that because the movable contact assembly arc contact assembly 32 and the fixed arc contact assembly 110 are coupled and in electrical communication, no arc forms between the movable main contact assembly 34 and the fixed main contact assembly 112.

The movement of the elements of the arc extinguishing contact assembly 24 as the movable contact assembly 20 moves from the second position to the first position are substantially the reverse of the movements described above in relation to the movable contact assembly 20 moving from the first position to the second position. That is, generally, the movable contact assembly 20 moves away from the fixed contact assembly 22. As this occurs, the upper housing assembly enclosed space 18' expands, and the pressure therein is reduced, and, the lower housing assembly enclosed space 18" collapses, and the pressure therein increases. In an exemplary embodiment, as described above, the first arc contact assembly conductive insert body second end tapered surface 389' is shaped to correspond to the movable contact assembly support member body passage upper portion 54. Thus, the intermediate first arc contact assembly conductive insert body second end 386' initially blocks, or plugs, the movable contact assembly support member body passage 50.

As the movable contact assembly 20 moves away from the fixed contact assembly 22, the movable main contact assembly 34 and the fixed main contact assembly 112 separate. At this time the movable contact assembly arc contact assembly 32 and the fixed arc contact assembly 110 are coupled and in electrical communication; thus, no arc forms between the movable main contact assembly 34 and the fixed main contact assembly 112.

As the movable contact assembly 20 continues to move away from the fixed contact assembly 22, the various arcing surfaces 64, 150, 398, 440, 470 separate. When the various arcing surfaces 64, 150, 398, 440, 470 separate, the various arcing surfaces 64, 150, 398, 440, 470 move into an arcing position. In an exemplary embodiment, the arcing surfaces 64, 150, 398, 440, 470 move into an arcing position substantially at the same time, i.e. substantially simultaneously during the opening, as well as during closing, of the contact assemblies 20, 22. That is, the fixed arc contact assembly conductive insert body second end arcing surface 150 and the first collapsible chamber intermediate second arc contact assembly conductive insert arcing surface 470A separate. Stated more broadly, the fixed arc contact assembly 110 separates from the first collapsible chamber intermediate second arc contact assembly conductive insert 450A. Further, the first collapsible chamber intermediate first arc contact assembly conductive insert arcing surface 398 and the second collapsible chamber intermediate second arc contact assembly conductive insert arcing surface 470B separate. Stated more broadly, the first collapsible chamber intermediate first arc contact assembly conductive insert 380A and the second collapsible chamber intermediate second arc contact assembly conductive insert 450B separate. Further, the second collapsible chamber intermediate first arc contact assembly conductive insert body second end arcing surface 440' and the movable contact assembly support member body passage upper portion arcing surface 64 separate. Stated more broadly, the second collapsible chamber intermediate first arc contact assembly conductive insert body 382' and the movable contact assembly arc contact assembly 32 separate. As before, the movement of the various elements are controlled by the positioning assemblies 216A, 216B, 216C at a synchronized rate. That is, the elements identified in this paragraph separate at substantially the same time. As these elements separate, an arc forms. In an alternate embodiment, the positioning assembly(ies) 216 are structured to move the various arcing surfaces 64, 150, 398, 440, 470 into an arcing position at different times. As noted above, FIGS. 10A-10G show an alternate exemplary sequence of movement when the contact assemblies 20, 22 separate. It is noted that in the alternate embodiment, the second collapsible chamber intermediate arc contact assembly support member conductive body 310B and the movable contact assembly arc contact assembly 32 separate prior to the separation of the other arc contacts, 110, 310A, Further, at this time, i.e. as the second collapsible chamber intermediate first arc contact assembly conductive insert body second end arcing surface 440' and the movable contact assembly support member body passage upper portion arcing surface 64 separate, the movable contact assembly support member body passage upper portion 54 is opened. That is, fluid may flow therethrough. As described above, the fluid control ports 90, 360, 600 are structured to create a vortex and generate a displaced low pressure zone regardless of the direction of the fluid flow. As such, when the arcing surfaces 64, 150, 398, 440, 470 separate and arcs form, the fluid flow assembly 700 simultaneously generates a vortex and displaced low pressure zone adjacent to the arcing surfaces 64, 150, 398, 440, 470. As before, this maintains the arcs between the various removable inserts 122, 380, 450 described above, before the arcs are extinguished. After the arcs are extinguished, the movable contact assembly 20 continues to move away from the fixed contact assembly 22 and the collapsible chambers 200A, 200B, 200C are returned to the expanded, first configuration.

Figure 9:
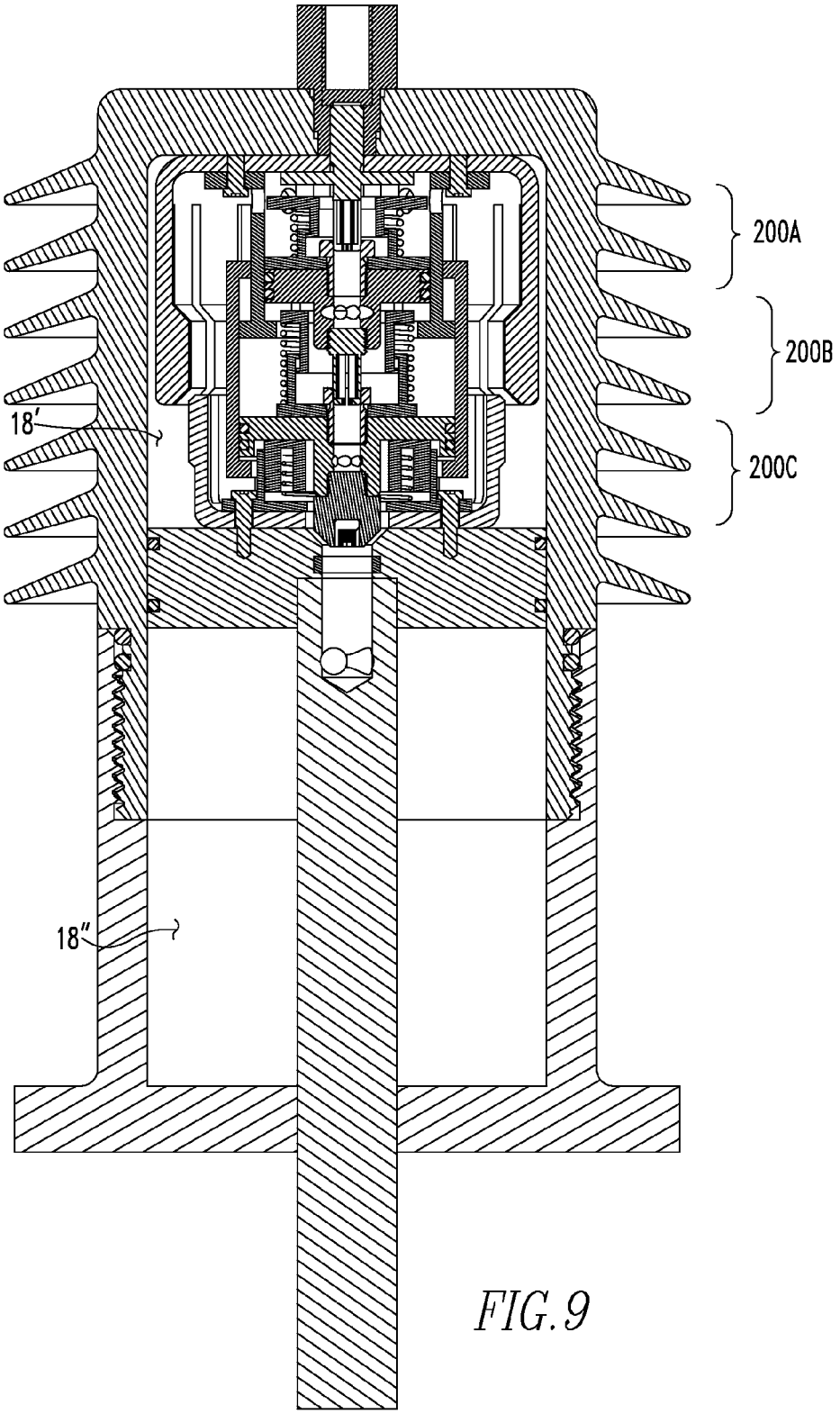
FIG. 9 is a schematic cross-sectional side view of a circuit breaker in a "relief valve" position.

It is noted, however, that during the movement of the movable contact assembly 20 from the second position to the first position, in an exemplary embodiment, the collapsible chamber 200C is structured to act as a "relief valve," as shown in FIG. 9.

That is, the collapsible chamber 200C are structured to reduce the pressure in the collapsible chambers 200A, 200B, 200C, as well as the upper housing assembly enclosed space 18'. This occurs after the movable main contact assembly 34 and the fixed main contact assembly 112 separate, but while the movable contact assembly arc contact assembly 32 and the movable contact assembly main contact assembly 34 are coupled to, and in electrical communication with, each other. As noted above, during the movement of the movable contact assembly 20 from the second position to the first position, the upper housing assembly enclosed space 18' expands, and the pressure therein is reduced, and, the lower housing assembly enclosed space 18" collapses, and the pressure therein increases. If the pressure in the lower housing assembly enclosed space 18" increases to a selected pressure, the third collapsible chamber positioning assembly 216C moves from the second configuration toward the first configuration. This motion allows the intermediate first arc contact assembly conductive insert body second end 386' to move away from the movable contact assembly support member body passage 50, thereby unblocking the movable contact assembly support member body passage 50. When this occurs, fluid passes through the movable contact assembly support member body passage 50 and into the upper housing assembly enclosed space 18'. When the pressure is generally balanced, the first arc contact assembly conductive insert body 382' moves into engagement with the movable contact assembly support member body 40 and the first arc contact assembly conductive insert body 382' again substantially blocks the movable contact assembly support member body passage 50. During the equalization of pressure an arc will form and will be controlled by the arc extinguishing assembly 26 as described above.

In an exemplary embodiment, the arc extinguishing assembly 26 utilizes additional elements or constructs to extinguish the arc(s). As noted above, in an exemplary embodiment, the first arc contact assembly conductive insert body 382' is used in the third collapsible chamber 200C. The first arc contact assembly conductive insert body 382' includes additional arc suppression features and, in an exemplary embodiment, both an arc attracting metal and an arc repelling material. As used herein, an "arc attracting metal" includes Hf, W embedded/braided with other passive metals, such as, but not limited to Ag, Pd and La. As used herein, an "an arc repelling material" includes, but is not limited to, ceramic, porcelain, alumina, and epoxy resins. The arc attracting metal and the arc repelling material are disposed in an arc controlling configuration. As used herein, an "arc controlling configuration" is a configuration of arc attracting metals and the arc repelling materials structured to maintain an arc within a specific area on the surface of a conductive element.

The configuration described above is one example of an arc controlling configuration. That is, the configuration described above includes the conductive first arc contact assembly conductive insert body 382' disposed concentrically about an arc attracting metal tubular outer sleeve 412'. The arc attracting metal tubular outer sleeve 412' is further disposed concentrically about an inner lug 414' made from an arc repelling material. In this configuration, the intermediate first arc contact assembly conductive insert body second end axial surface 402' includes an outer surface 422', a medial surface 424', and a central surface 426'. The intermediate first arc contact assembly conductive insert body second end outer surface 422' is, in an exemplary embodiment, copper. The intermediate first arc contact assembly conductive insert body second end medial surface 424' is made from the arc attracting metal. The intermediate first arc contact assembly conductive insert body second end central surface 426' is made from the arc repelling material. In this configuration, an arc that forms between the intermediate first arc contact assembly conductive insert body 382' and another element is drawn toward the intermediate first arc contact assembly conductive insert body second end medial surface 424'. Thus, this configuration is an "arc controlling configuration."

The arc extinguishing assembly 26, in an exemplary embodiment, utilizes an arc suppressing fluid 800, or gas. That is, the arc suppressing fluid 800 is used in the enclosed space 18 which includes all the collapsible chamber enclosed spaces 202. In an exemplary embodiment, the arc suppressing fluid 800 is selected from one of the following groups:

Oxides of certain non-metallic or gaseous elements: e.g. $CO_2$, $SO_2$, $N_2O$.

Fluoride of the nonmetals: $BF_3$, $NF_3$ (as fluorine gas a electronegative gas).

Hydrogen compounds of certain elements: e.g. $CH_4$, $NH_3$.

Diatomic gases: $O_2$, $N_2$, $F_2$, $H_2$.

Inert gases: He, Ar, Ne, Kr, Xe, etc.

Air, modified air (any mixture of $N_2$ and $O_2$).

Mixtures of gases: $H_{35}$ (35% $H_2$ and 65% Ar), $F_5$ (95% $N_2$ and 5% H), Arcal (mixture of Ar, $CO_2$, He, $O_2$).

In another embodiment, the arc suppressing fluid 800 is a mixture of all of the gasses set forth above.

In an exemplary embodiment, the arc suppressing fluid 800 is an environmentally friendly gas 802. As used herein, an "environmentally friendly gas" includes Air, $CO_2$, $O_2$, $N_2$, NO and mixtures thereof. In one embodiment, an environmentally friendly gas 802 includes a mixture of $CO_2$, $O_2$ and $N_2$. In one embodiment, the mixture includes between about 25-90% $CO_2$, between about 1-20% $O_2$, and between about 1-75% $N_2$. In another embodiment, the mixture includes between about 30-60% $CO_2$, between about 5-15% $O_2$, and between about 30-60% $N_2$. In another embodiment, the mixture includes between about 40-50% $CO_2$, between about 5-10% $O_2$, and between about 40-50% $N_2$. In another embodiment, the mixture includes between about 42-48% $CO_2$, between about 8-10% $O_2$, and between about 42-48% $N_2$. In another embodiment, the ratio of C:N:O is about 1:2:2.44.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An arc extinguishing contact assembly for a circuit breaker assembly, the circuit breaker assembly including a housing assembly and an operating mechanism, said housing assembly defining an enclosed space, said operating mechanism structured to be operatively coupled to a movable contact assembly and structured to move the movable contact assembly between an open, first position, wherein the movable contact assembly is effectively spaced from a fixed contact assembly, and a closed, second position, wherein the movable contact assembly is coupled to, and in electrical communication with, the fixed contact assembly, said arc extinguishing contact assembly comprising:

a fixed contact assembly including an arc contact assembly, a main contact assembly, and a number of movable, intermediate arc contact assemblies;

a movable contact assembly including an arc contact assembly and a main contact assembly, said movable contact assembly structured to move between an open, first position, wherein the movable contact assembly is effectively spaced from said fixed contact assembly, and a closed, second position, wherein the movable contact assembly is coupled to, and in electrical communication with, said fixed contact assembly, with an arcing position there between;

an arc extinguishing assembly structured to extinguish a number of arcs generated as said movable contact assembly moves between said first position and said second position;

wherein said arc extinguishing assembly is structured to divide a theoretical arc into multiple local arcs wherein the local arcs have a reduced voltage relative to said theoretical arc;

wherein each intermediate arc contact assembly generates at least one local arc;

each intermediate arc contact assembly includes a first arc contact assembly and a second arc contact assembly;

each said fixed arc contact assembly includes an arcing surface;

each said intermediate first arc contact assembly includes an arcing surface;

each said intermediate second arc contact assembly includes an arcing surface;

each said movable arc contact assembly includes an arcing surface; and each said local arc is generated from at least one of an intermediate first arc contact assembly arcing surface or an intermediate second arc contact assembly arcing surface.

2. An arc extinguishing contact assembly for a circuit breaker assembly, the circuit breaker assembly including a housing assembly and an operating mechanism, said housing assembly defining an enclosed space, said operating mechanism structured to be operatively coupled to a movable contact assembly and structured to move the movable contact assembly between an open, first position, wherein the movable contact assembly is effectively spaced from a fixed contact assembly, and a closed, second position, wherein the movable contact assembly is coupled to, and in electrical communication with, the fixed contact assembly, said arc extinguishing contact assembly comprising:

a fixed contact assembly including an arc contact assembly, a main contact assembly, and a number of movable, intermediate arc contact assemblies;

a movable contact assembly including an arc contact assembly and a main contact assembly, said movable contact assembly structured to move between an open, first position, wherein the movable contact assembly is effectively spaced from said fixed contact assembly, and a closed, second position, wherein the movable contact assembly is coupled to, and in electrical communication with, said fixed contact assembly, with an arcing position there between;

an arc extinguishing assembly structured to extinguish a number of arcs generated as said movable contact assembly moves between said first position and said second position;

wherein said arc extinguishing assembly is structured to divide a theoretical arc into multiple local arcs wherein the local arcs have a reduced voltage relative to said theoretical arc;

wherein each intermediate arc contact assembly generates at least one local arc;

each intermediate arc contact assembly includes a first arc contact assembly and a second arc contact assembly;

each said fixed arc contact assembly includes an arcing surface;

each said intermediate first arc contact assembly includes an arcing surface;

each said intermediate second arc contact assembly includes an arcing surface;

each said movable arc contact assembly includes an arcing surface; and each said intermediate first arc contact assembly arc surface and intermediate second arc contact assembly arc surface is disposed on a removable component.

3. The arc extinguishing contact assembly of claim 2 wherein:

said fixed arc contact assembly includes a conductive base member and a conductive insert, wherein said fixed arc contact assembly conductive insert is removably coupled to said fixed arc contact assembly base member;

each intermediate arc contact assembly includes a support member;

each said intermediate first arc contact assembly includes a conductive insert, wherein each said intermediate first arc contact assembly conductive insert is removably coupled to an associated intermediate arc contact assembly support member; and each said intermediate second arc contact assembly includes a conductive insert, wherein each said intermediate second arc contact assembly conductive insert is removably coupled to an associated intermediate arc contact assembly support member.

4. The arc extinguishing contact assembly of claim 3 wherein:

at least one said intermediate first arc contact assembly conductive insert includes an elongated body;

said at least one intermediate first arc contact assembly conductive insert body includes a proximal, first end and a distal, second end;

said at least one intermediate first arc contact assembly conductive insert body second end includes an axial surface;

said at least one intermediate first arc contact assembly conductive insert body second end axial surface includes an outer surface, a medial surface, and a central surface;

said outer surface extending about said medial surface;

said medial surface extending about said central surface;

wherein said medial surface is made from an arc attracting metal; and wherein said central surface is made from an arc repelling material.

5. The arc extinguishing contact assembly of claim 4 wherein:

said arc attracting metal is selected from the group consisting of Hf, W and mixtures thereof; and said arc repelling material is selected from the group consisting of ceramic, porcelain, alumina, epoxy resins, and mixtures thereof.

6. The arc extinguishing contact assembly of claim 4 wherein each said intermediate second arc contact assembly conductive insert includes an elongated body including an inner surface defining a passage.

7. The arc extinguishing contact assembly of claim 1 wherein said arc extinguishing assembly utilizes an arc suppressing fluid.

8. The arc extinguishing contact assembly of claim 7 wherein said arc suppressing fluid is selected from the group consisting of non-metallic oxides and gaseous elements, nonmetal fluoride, hydrogen compounds, diatomic gases, inert gases, modified air, mixtures of gases, environmentally friendly gases, and mixtures and combinations thereof.

9. The arc extinguishing contact assembly of claim 8 wherein said nonmetals fluoride are selected from the group consisting of $BF_3$, $NF_3$, and mixtures thereof.

10. The arc extinguishing contact assembly of claim 8 wherein said non-metallic oxides and gaseous elements are selected from the group consisting of $CO_2$, $SO_2$, $N_2O$, and mixtures thereof.

11. The arc extinguishing contact assembly of claim 8 wherein said hydrogen compounds are selected from the group consisting of $CH_4$, $NH_3$, and mixtures thereof.

12. The arc extinguishing contact assembly of claim 8 wherein said diatomic gases are selected from the group consisting of $O_2$, $N_2$, $F_2$, $H_2$, and mixtures thereof.

13. The arc extinguishing contact assembly of claim 8 wherein said inert gases are selected from the group consisting of He, Ar, Ne, Kr, Xe, and mixtures thereof.

14. The arc extinguishing contact assembly of claim 8 wherein said modified air is any mixture of $N_2$ and $O_2$.

15. The arc extinguishing contact assembly of claim 8 wherein said mixtures of gases are selected from the group consisting of $H_{35}$ (35% $H_2$ and 65% Ar), $F_5$ (95% $N_2$ and 5% H), Arcal (Ar, $CO_2$, He, $O_2$), and mixtures thereof.

16. The arc extinguishing contact assembly of claim 8 wherein said environmentally friendly gases are selected from the group consisting of Air, $CO_2$, $O_2$, $N_2$, NO, and mixtures thereof.

* * * * *